US010002563B2

(12) United States Patent
Ota et al.

(10) Patent No.: US 10,002,563 B2
(45) Date of Patent: Jun. 19, 2018

(54) ELECTRO-OPTICAL DEVICE HAVING PIXEL CIRCUIT AND DRIVING CIRCUIT, DRIVING METHOD OF ELECTRO-OPTICAL DEVICE AND ELECTRONIC APPARATUS

(71) Applicant: SEIKO EPSON CORPORATION, Tokyo (JP)

(72) Inventors: Hitoshi Ota, Shiojiri (JP); Hideto Ishiguro, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days. days.

(21) Appl. No.: 15/657,768

(22) Filed: Jul. 24, 2017

(65) Prior Publication Data

US 2017/0323597 A1 Nov. 9, 2017

Related U.S. Application Data

(63) Continuation of application No. 15/248,503, filed on Aug. 26, 2016, now Pat. No. 9,747,833, which is a (Continued)

(30) Foreign Application Priority Data

Oct. 18, 2011 (JP) ..... 2011-228885

(51) Int. Cl.
*G09G 3/30* (2006.01)
*G09G 3/3225* (2016.01)
(Continued)

(52) U.S. Cl.
CPC ..... *G09G 3/3225* (2013.01); *G09G 3/2096* (2013.01); *G09G 3/3233* (2013.01);
(Continued)

(58) Field of Classification Search
CPC ... G09G 3/3225; G09G 3/3275; G09G 3/3233
(Continued)

(56) References Cited

U.S. PATENT DOCUMENTS 6,825,836 B1 11/2004 Stewart et al.
2003/0103022 A1 6/2003 Noguchi et al.
(Continued)

FOREIGN PATENT DOCUMENTS

JP 2002-0516417 A 6/2002
JP 2003-208127 A 7/2003
(Continued)

OTHER PUBLICATIONS

Aug. 29, 2014 Office Action issued in U.S. Appl. No. 13/653,964.
(Continued)

*Primary Examiner* — Adam J Snyder
(74) *Attorney, Agent, or Firm* — Oliff PLC

(57) ABSTRACT

An electro-optical device includes a first storage capacitor that has a first electrode and a second electrode, and a second storage capacitor that has a third electrode and a fourth electrode, and a first pixel circuit. The first pixel circuit includes a first transistor having a first gate, a first drain, and a first source, an electro-optical element, a second transistor through which a first data line is electrically connected to the first gate during the second transistor is in an on-state, and a third transistor through which the first gate is electrically connected to the first drain or the first source. The second electrode and the third electrode are electrically connected to the first data line.

6 Claims, 17 Drawing Sheets

Related U.S. Application Data continuation of application No. 14/943,583, filed on Nov. 17, 2015, now Pat. No. 9,454,927, which is a continuation of application No. 13/653,964, filed on Oct. 17, 2012, now Pat. No. 9,224,333.

(51) Int. Cl.

| | |
|---|---|
| ***G09G 3/3233*** | (2016.01) |
| ***G09G 3/20*** | (2006.01) |
| *G09G 3/10* | (2006.01) |
| *G09G 3/3275* | (2016.01) |

(52) U.S. Cl.

CPC ... *G09G 3/3275* (2013.01); *G09G 2300/0426* (2013.01); *G09G 2300/0439* (2013.01); *G09G 2300/0814* (2013.01); *G09G 2300/0819* (2013.01); *G09G 2310/0264* (2013.01); *G09G 2310/08* (2013.01); *G09G 2320/045* (2013.01)

(58) Field of Classification Search

USPC ..... 345/76; 315/169.3

See application file for complete search history.

(56) References Cited

U.S. PATENT DOCUMENTS

| | | | | |
|---|---|---|---|---|
| 2003/0132907 | A1 | 7/2003 | Lee et al. | |
| 2004/0125067 | A1* | 7/2004 | Kim | G09G 3/3614 345/98 |
| 2004/0251846 | A1 | 12/2004 | Choi et al. | |
| 2005/0007316 | A1 | 1/2005 | Akimoto et al. | |
| 2005/0243034 | A1 | 11/2005 | Chung et al. | |
| 2007/0057877 | A1* | 3/2007 | Choi | G09G 3/3233 345/76 |
| 2007/0273619 | A1 | 11/2007 | Kitazawa et al. | |
| 2009/0207110 | A1 | 8/2009 | Lee et al. | |
| 2009/0251455 | A1 | 10/2009 | Park et al. | |
| 2011/0050741 | A1* | 3/2011 | Jeong | G09G 3/3233 345/690 |
| 2011/0141084 | A1 | 6/2011 | Kishi | |

FOREIGN PATENT DOCUMENTS

| | | | | |
|---|---|---|---|---|
| JP | 2005-316381 | A | 11/2005 | |
| JP | 2005-321433 | A | 11/2005 | |
| JP | 2007-316462 | A | 12/2007 | |
| JP | 2009-288435 | A | 12/2009 | |
| JP | 2011-033678 | A | 2/2011 | |
| JP | 2011-039269 | A | 2/2011 | |
| JP | 2011039269 | A * | 2/2011 | G09G 3/30 |

OTHER PUBLICATIONS

Feb. 4, 2015 Office Action issued in U.S. Appl. No. 13/653,964.

U.S. Appl. No. 13/653,964, filed Oct. 17, 2012 in the name of Ota et al.

Feb. 19, 2016 Office Action issued in U.S. Appl. No. 14/943,583.

U.S. Appl. No. 14/943,583, filed Nov. 17, 2015 in the name of Ota et al.

Dec. 8, 2016 Office Action Issued in U.S. Appl. No. 15/248,503.

* cited by examiner

ELECTRO-OPTICAL DEVICE HAVING PIXEL CIRCUIT AND DRIVING CIRCUIT, DRIVING METHOD OF ELECTRO-OPTICAL DEVICE AND ELECTRONIC APPARATUS

This is a Continuation of application Ser. No. 15/248,503 filed Aug. 26, 2016, which is a Continuation of application Ser. No. 14/943,583 filed Nov. 17, 2015, which is a Continuation of application Ser. No. 13/653,364 filed Oct. 17, 2012, which claims the benefit of Japanese Application No. 2011-228885 filed Oct. 18, 2011. The disclosures of the prior applications are hereby incorporated by reference herein in their entireties.

BACKGROUND

1. Technical Field

The disclosed embodiments of the present invention relate to an electro-optical device, a driving method of an electro-optical device and an electronic apparatus effective when miniaturizing a pixel circuit, for example.

2. Related Art

In recent years, various kinds of electro-optical devices using light emitting elements such as organic light-emitting diode (Organic Light Emitting Diode, hereinafter referred to as "OLED") elements have been proposed. In such electro-optical devices, generally, a pixel circuit corresponding to the intersections of scanning lines and data lines and including the above-described light emitting elements or transistors is configured so as to be provided to correspond to pixels in an image to be displayed. In such a configuration, when a data signal of a potential corresponding to the gradation level of pixels is applied to the gate of the transistor, the transistor supplies a current corresponding to the voltage between the gate and the source to the light emitting element. In this manner, the light emitting element emits light with a luminance corresponding to the gradation level. At this time, when the characteristics such as the threshold voltage of the transistor are varied in each pixel circuit, display nonuniformity impairing the uniformity of the display screen is generated. For this reason, a technique of compensating for the characteristics of the transistor has been, proposed (for example, refer to JP-A-2007-316462).

Further, with respect to the electro-optical devices, there is often a demand for miniaturization of the display size or an increase in the high definition of the display. Since it is necessary to miniaturize the pixel circuit in order to achieve both miniaturization of the display size and an increase in the high definition of the display, for example, a technique of providing the electro-optical device with a silicon integrated circuit has also been proposed (for example, refer to JP-A-2009-288435).

Here, in the miniaturization of the pixel circuit, it is necessary to control the current supplied to the light-emitting element in a micro region. The current supplied to the light-emitting element is controlled according to the voltage between the gate and the source of the transistor; however, in the micro region, the current supplied to the light-emitting element is greatly changed with respect to slight changes in the voltage between the gate and the source.

Meanwhile, the driving capability of the circuit outputting the data signal is increased in order to charge the data lines in a short time. In a circuit having a high driving capability in this manner, it is difficult to output the data signal with extremely fine precision.

SUMMARY

An advantage of some aspects of the invention is that it provides an electro-optical device, a driving method of an electro-optical device and an electronic apparatus capable of supplying the current supplied to a light emitting element with high precision while compensating for the characteristics of the transistor without a need for a data signal with fine precision.

According to an aspect of the invention, there is provided an electro-optical device, including: a plurality of scanning lines; a plurality of data lines; a first storage capacitor of which one end is connected to the data lines; a second storage capacitor respectively holding various potentials of the plurality of data lines; a pixel circuit provided so as to correspond to intersections of the plurality of scanning lines and the plurality of data lines; and a driving circuit driving the pixel circuit, in which the pixel circuit includes a first transistor supplying current according to a voltage between a gate and a source, a light emitting element emitting light with a luminance corresponding to current supplied by the first transistor, a second transistor which is turned on or off between the data lines and the gate of the first transistor, and a third transistor which is turned on or off between the gate and the drain of the first transistor, in which the first transistor and the light emitting element are connected in series between a power source of a high-order side and a power source of a low-order side, and in which the driving circuit electrically connects the data lines and a first feed line feeding an initial potential and electrically connects another end of the first storage capacitor and a second feed line feeding a predetermined potential in a first period, sets the data lines and the first feed line as electrically unconnected in a second period continuing on from the first period, turns on the second transistor and the third transistor in a state where the connection of the other end of the first storage capacitor and the second feed line is maintained, sets the other end of the first storage capacitor and the second feed line as electrically unconnected and supplies a signal of a potential corresponding to the luminance to the other end of the first storage capacitor in a third period continuing on from the second period, and turns off the second transistor after the third period.

According to another aspect of the invention, in the first period, the data lines, the first storage capacitor, and the second storage capacitor are initialized. In the second period, when the second transistor and the third transistor are respectively turned on, the data lines and the gate of the first transistor become a potential corresponding to the threshold voltage of the first transistor. In the third period, when a signal of a potential corresponding to the luminance is supplied to the other end of the first storage capacitor in a state where the second transistor is turned on, the data lines and the gate of the first transistor are shifted from the potential according to the threshold voltage by an amount by which the potential variation in the other end of the first storage capacitor is voltage-divided by the capacity ratio. As a result, the potential range in the gate of the first transistor can be narrowed with respect to the potential range in the other end of the first storage capacitor. For this reason, according to another aspect of the invention, it is possible to accurately supply the current supplied to the light emitting element while compensating for the characteristics of the transistor without the need for a data signal of fine precision.

In an embodiment of the present invention, it is preferable that a third storage capacitor corresponding to the data lines be included and that the driving circuit is configured to temporarily hold the data signal of the potential according to the gradation level supplied before the third period and to supply the potential held in the third storage capacitor to the other end of the first storage capacitor as the signal of a potential corresponding to the luminance in a third period.

As such a configuration, a preferable aspect has a first switch and a second switch corresponding to the third storage capacitor, in which the output end of the first switch is connected to the other end of the first storage capacitor, the input end of the first switch is connected to one end of the third storage capacitor and the output end of the second switch, the data signal is supplied to the input end of the second switch before the third period, the driving circuit turns on the second switch in a state where the first switch is turned off before the third period and turns on the first switch in a state where the second switch is turned on in the third period.

In this aspect, in at least the first period or the second period, when the data signal is supplied to the input end of the second switch it is possible to simultaneously perform the supply of the data signal and an operation setting the potential according to the threshold voltage of the first transistor at the gate.

Further, in this aspect, the data lines are grouped every plurality of lines and the input end of the second switch corresponding to the data lines of the plurality of lines belonging to one group is connected in common thereto and the driving circuit may turn on the plurality of second switches belonging to one group in a predetermined order to match the supply of the data signal.

In an embodiment of the present invention, the pixel circuit may be configured to include a fourth transistor, which is turned on or off between a terminal of the first transistor side among two terminals in the light emitting element and a third feed line feeding a predetermined reset potential. According to this configuration, it is possible to suppress the influence of the holding voltage of the capacity having a parasitic effect on the light emitting element.

In this configuration, there may be an aspect in which the third feed lines are provided in plural along the data lines for each of the plurality of data lines.

In this aspect, when a configuration is adopted in which one end of the second storage capacitor is connected to the data lines, the other end of the second storage capacitor is connected to the third feed lines, for example, when the second storage capacitor is configured by interposing an insulating layer between the data line and the third feed line, it is possible to form a comparatively large capacity in a small space as the second storage capacitor.

The driving circuit may be configured to turn off the third transistor in the third period.

Further, the pixel circuit may have a fifth transistor which turns on and off in the route of the current supplied to the light emitting element by the first transistor and the driving circuit may turn off the fourth transistor and turn on the fifth transistor. In this manner, it is possible to set the period in which the capacity having a parasitic effect on the light emitting element is reset and the period in which current is supplied to the light emitting element and light is emitted to be exclusive.

The pixel circuit may include a fourth storage capacitor holding the voltage between the gate and the source of the first transistor. This fourth storage capacitor may be a parasitic capacitance of the first transistor, or may be a capacitive element provided separately.

Here, as well as the electro-optical device, an embodiment of present the invention can also be conceptualized as a driving method of an electro-optical device or an electronic apparatus having the electro-optical device. As the electronic apparatus, typically, a display apparatus such as a head-mounted display (HMD), an electronic view finder, or the like may be exemplified.

BRIEF DESCRIPTION OF THE DRAWINGS

The foregoing and other objects, features, aspects and advantages of the invention will be described with reference to the accompanying drawings, wherein like numbers reference like elements.

FIG. 17 is a perspective view showing an HMD using the electro-optical device according to the embodiments and the like.

DETAILED DESCRIPTION

Below, aspects for embodying the disclosed embodiments of the present invention will be described with reference to the drawings.

First Embodiment

Figure 1:
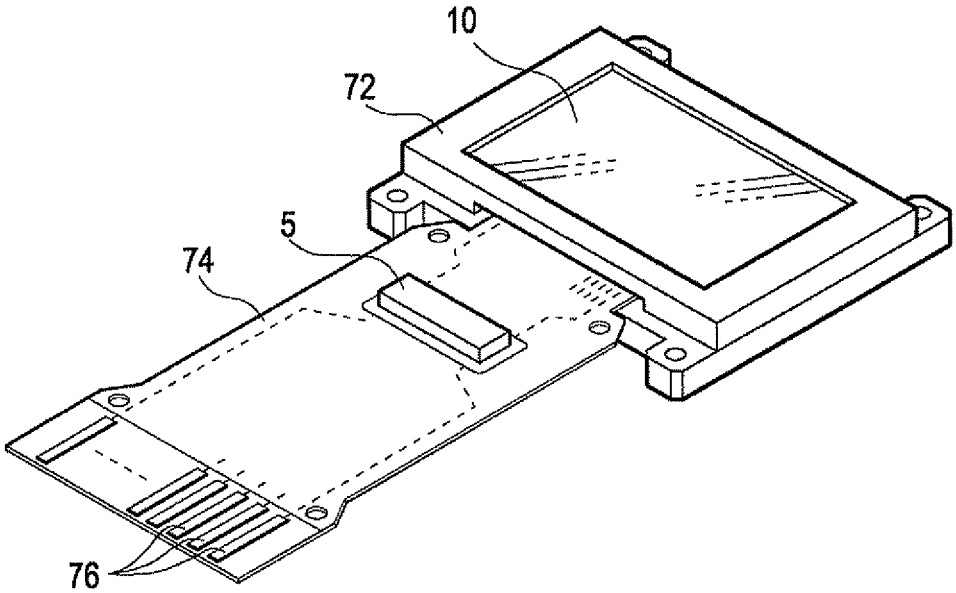
FIG. 1 is a perspective view illustrating a configuration of an electro-optical device according to a first embodiment of the invention.

FIG. 1 is a perspective view showing a configuration of an electro-optical device 10 according to an embodiment of the invention.

The electro-optical device 10 is a micro display displaying an image in a head mounted display, for example. The electro-optical device 10 will be described in detail below; however, it is an organic EL apparatus in which a plurality of pixel circuits, driving circuits driving the pixel circuits, and the like are, for example, formed on a silicon substrate, and in which an OLED which is an example of a light emitting element is used in the pixel circuits.

As well as being accommodated in a frame-shaped case 72 opening at a display unit, the electro-optical device 10 is connected to one end of a FPC (Flexible Printed Circuit) substrate 74. In the FPC substrate 74, a control circuit 5 of a semiconductor chip is mounted using a COF (Chip On Film) technique and a plurality of terminals 76 are provided and connected to a higher circuit omitted from the drawings. Image data is synchronized with a synchronization signal and supplied via the plurality of terminals 76 from the higher circuit. The synchronization signal includes a vertical synchronization signal, a horizontal synchronization signal, and a dot clock signal. In addition, the image data regulates the gradation level of the pixels of the image to be displayed, for example, using 8 bits.

The control circuit 5 combines the functions of a power circuit of the electro-optical device 10 and a data signal output circuit. That is, the control circuit 5 supplies various types of control signals generated according to the synchronization signal and various types of potential to the electro-optical device 10, and converts the digital image data into an analog data signal to be supplied to the electro-optical device 10.

Figure 2:
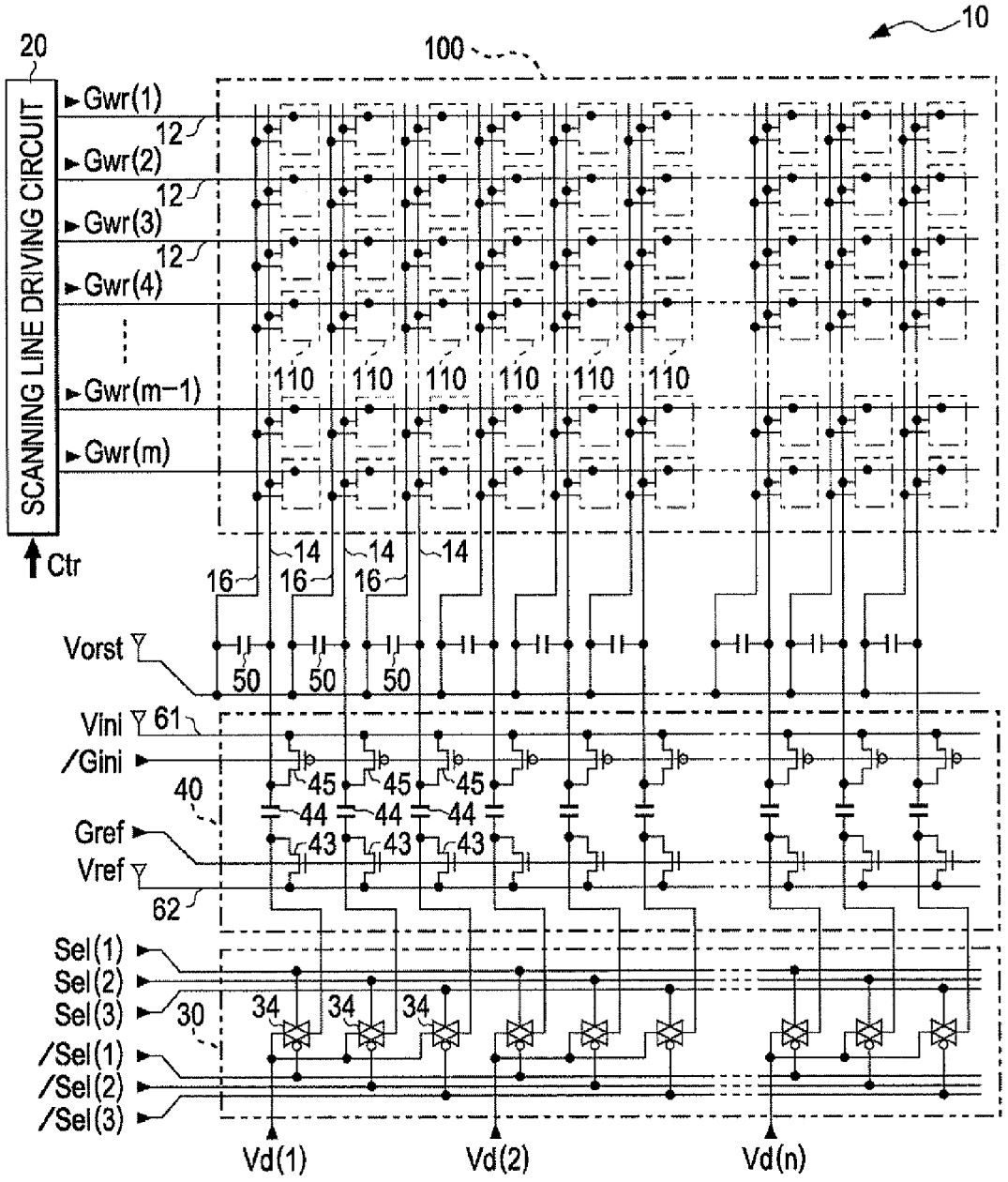
FIG. 2 is a diagram showing a configuration of the electro-optical device.

FIG. 2 is a diagram showing a configuration of an electro-optical device 10 according to the first embodiment. As shown in the diagram, the electro-optical device 10 is divided into a scanning line driving circuit 20, a demultiplexer 30, a level shift circuit 40, and a display unit 100.

Among these, in the display unit 100, pixel circuits 110 corresponding to pixels of the image to be displayed are arranged in a matrix form. In detail, in the display unit 100, scanning lines 12 of m rows are provided to extend in the horizontal direction in the diagram, and, furthermore, data lines 14 of (3n) columns grouped in sets of three are provided to extend in the vertical direction in the diagram and preserve the mutual electrical insulation with each scanning line 12. Here, the pixel circuits 110 are provided corresponding to intersection portions of m rows of scanning lines 12 and (3n) columns of data lines 14. For this reason, the pixel circuits 110 in the present embodiment are arranged in a matrix form with m rows vertically and (3n) columns horizontally.

Here, m and n are both natural numbers. In the matrix of the scanning lines 12 and the pixel circuit 110, in order to distinguish between the rows, the rows have been numbered 1, 2, 3, . . . , (m−1), and m in order from the top in the diagram. In the same manner, in order to distinguish between the columns of the matrix of the data lines 14 and the pixel circuits 110, the columns have been numbered 1, 2, 3, . . . , (3n−1), and (3n) in order from the left in the diagram. In addition, when an integer j of 1 or more and n or less is used in order to generalize and describe a group of the data lines 14, the (3j−2)th column, the (3j−1)th column, and the (3j)th column of the data lines 14 belong to the jth group counting from the left.

Here, three pixel circuits 110 corresponding to intersections of scanning lines 12 of the same row and three columns of data lines 14 belonging to the same group correspond to pixels of R (red), G (green), and B (blue) respectively and these three pixels represent one dot of a color image to be displayed. That is, the present embodiment has a configuration in which colors of one dot are represented by adding and mixing colors according to the light emission of OLEDs corresponding to RGB.

In the present embodiment, feed lines 16 (third feed lines) are respectively provided along the data lines 14 in each column. A potential Vorst as a reset potential is fed in common to each feed line 16. Further, a storage capacitor 50 is provided at each column. In detail, one end of the storage capacitor is connected to the data line 14 and the other end is connected to the feed line 16. For this reason, the storage capacitor 50 functions as a second storage capacitor holding the potential of the data line 14.

Here, the storage capacitor 50 is preferably configured to be formed by interposing an insulating layer (dielectric layer) between the wiring configuring the data lines 14 and the wiring configuring the feed lines 16.

Further, the storage capacitor 50 is provided on the outside of the display unit 100 in FIG. 2; however, this is only an equivalent circuit and the storage capacitor may obviously be provided in the inside of the display unit 100 or from the inside to the outside thereof. Further, although omitted in FIG. 2, the capacity of the storage capacitor 50 is set to Cdt.

Here, in the electro-optical device 10, the following kind of control signal is supplied by the control circuit 5. In detail, in the electro-optical device 10, a control signal Ctr for controlling the scanning line driving circuit 20, control signals Sel(1), Sel(2), and Sel(3) for controlling the selection with the demultiplexer 30, control signals /Sel(1), /Sel(2), and /Sel(3) in a logic inversion relationship with respect to these signals, a negative logic control signal /Gini, and a positive logic control signal /Gref for controlling the level shift circuit 40, are supplied. Here, in practice, the control signal Ctr includes a plurality of signals such as a pulse signal, a clock signal, and an enable signal.

Further, in the electro-optical device 10, data signals Vd(1), Vd(2), . . . , Vd(n) matching the selection timing of the demultiplexer 30 are supplied by the control circuit 5 to correspond to groups numbered 1, 2, . . . , n. Here, the highest value of the potential obtainable by the data signals Vd(1) to Vd(n) is set as Vmax and the lowest value is set to Vmin.

The scanning line driving circuit 20 generates scanning signals for scanning the scanning lines 12 one row at a time in order over a frame period in accordance with the control signal Ctr. Here, the scanning signals supplied to the scanning lines 12 of 1, 2, 3, . . . , (m−1), m rows are respectively denoted as Gwr(1), Gwr(2), Gwr(3), Gwr(m−1), and Gwr (m).

In addition, apart from the scanning signals Gwr(1) to Gwr(m), the scanning line driving circuit 20 generates various types of control signals synchronized with the scanning signals for each row and performs supply thereof to the display unit 100; however, such illustration is omitted in FIG. 2. Further, the frame period refers to a period necessary for the electro-optical device 10 to display one cut (frame) part of an image, for example, if the frequency of the vertical synchronization signal included in the synchronization signal is 120 Hz, the period is 8.3 milliseconds which is the duration of one cycle.

The demultiplexer 30 is an assembly of transmission gates 34 provided at each column and supplies data signals in order to the three columns configuring each group.

Here, the input ends of the transmission gate 34 corresponding to columns (3j−2), (3j−1), and 3(j) belonging to the j-numbered groups are mutually connected in common and respective data signals Vd(j) are supplied to the common terminals.

The transmission gate 34 provided at column (3j−2) at the left end column in the j-numbered groups is turned on (conducts) when the control signal Sel(1) is the H level (when the control signal /Sel(1) is the L level). Similarly, the transmission gate 34 provided at column (3j−1) at the center column in the j-numbered groups is turned on when the control signal Sel(2) is the H level (when the control signal /Sel(2) is the L level), and the transmission gate 34 provided at column (3j) at the right end column in the j-numbered groups is turned on when the control signal Sel(3) is the H level (when the control signal /Sel(3) is the L level).

The level shift circuit 40 has a set of a storage capacitor 44, a P-channel MOS-type transistor 45 and an N-channel MOS-type transistor 43 for each column, and shifts the potential of the data signal output from the output end of the transmission gate 34 of each column. Here, one end of the storage capacitor 44 is connected to a data line 14 of a corresponding column and a drain node of a transistor 45 while the other end of the storage capacitor 44 is connected to the output end of the transmission gate 34 and the drain node of the transistor 43. For this reason, the storage capacitor 44 functions as a first storage capacitor in which one end is connected to the data line 14. Although omitted from FIG. 2, the capacity of the storage capacitor 44 is set as Crf1.

The source nodes of the transistors 45 of each column are mutually connected across each column to the feed line 61 feeding a potential Vini as an initialization potential and the control signal /Gini is supplied in common across each column to the gate nodes. For this reason, the transistor 45 is configured such that the data line 14 and the feed line 61 are electrically connected when the control signal /Gini is the L level and electrically unconnected when the control signal /Gini is the H level.

Further, the source nodes of the transistors 43 of each column are mutually connected across each column to the feed line 62 feeding a potential Vref as a predetermined potential and the control signal Gref is supplied in common across each column to the gate nodes. For this reason, the transistor 43 is configured such that the node h which is the other end of the storage capacitor 44 and the feed line 62 are electrically connected when the control signal Gref is the H level and electrically unconnected when the control signal Gref is the L level.

In the present embodiment, the scanning line driving circuit 20, the demultiplexer 30, and the level shift circuit 40 are divided according to convenience; however, these can be conceived together as a driving circuit driving the pixel circuit 110.

The pixel circuit 110 will be described with reference to FIG. 3. Since each pixel circuit 110 has the same configuration as the others in electrical terms, here, description will be given taking the pixel circuit 110 of the i-th row (3j−2) column positioned at the (3j−2)th column of the left end side in the j-numbered group in the i-th row as an example.

Here, i is a sign used in a case to generally show a row in which the pixel circuit 110 is arranged, and is an integer of one or more and m or less.

Figure 3:
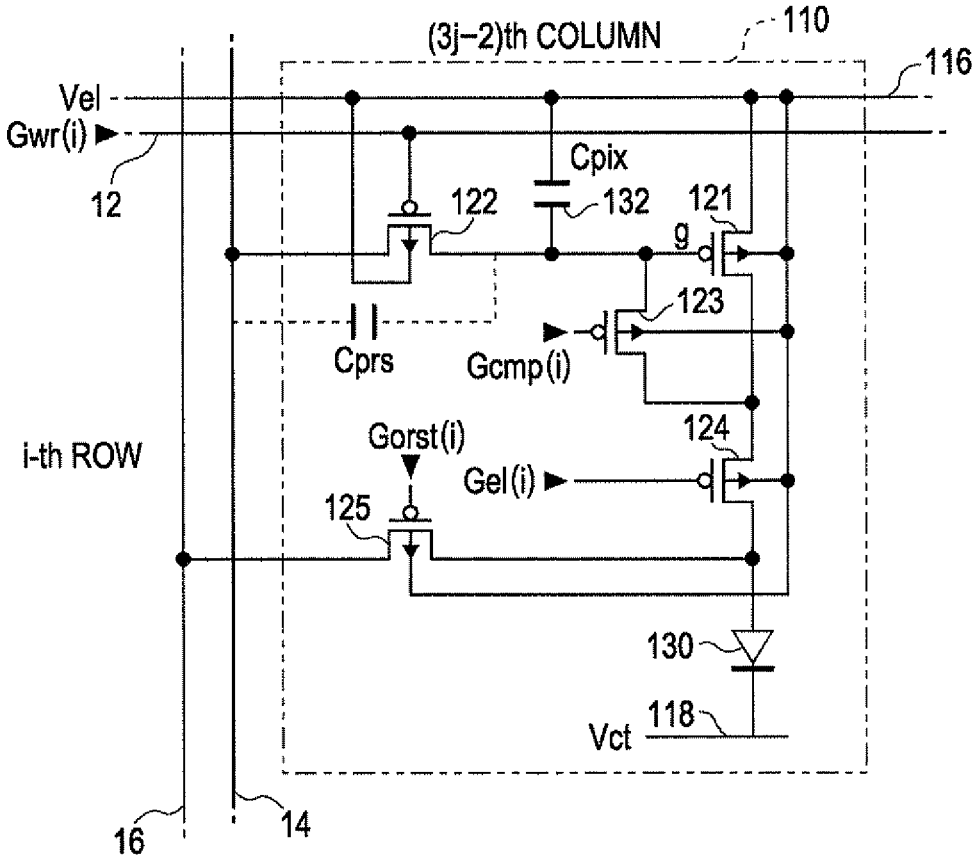
FIG. 3 is a diagram showing a pixel circuit of the electro-optical device.

As shown in FIG. 3, the pixel circuit 110 includes P-channel MOS-type transistors 121 to 125, an OLED 130 and a storage capacitor 132. The scanning signal Gwr(i) and the control signals Gel(i), Gcmp(i), and Gorst(i) are supplied to the pixel circuit 110. Here, the scanning signal Gwr(i) and the control signals Gel(i), Gcmp(i), and Gorst(i) are supplied by the scanning line driving circuit 20 in correspondence with the respective i-th rows. For this reason, in the case of an i-th row, the scanning signal Gwr(i) and the control signals Gel(i), Gcmp(i), and Gorst(i) are also supplied in common to the pixel circuits of other columns other than column (3j−2) being focused on.

In the transistor 122 in the pixel circuit 110 of the i-th row, (3j−2)th column, the gate node is connected to the scanning line 12 of the i-th row, one of the drain or source node is connected to the data line 14 of the (3j−2)th column, and the other is respectively connected to the gate node g in the transistor 121, one end of the storage capacitor 132, and the drain node of the transistor 123. Here, the gate node of transistor 121 is denoted as g so as to be distinguished from other nodes.

In the transistor 121, the source node is connected to the feed line 116 and the drain nodes are respectively connected to the source node of the transistor 123 and the source node of the transistor 124. Here, the potential Vel which is the high-order side of the power source in the pixel circuit 110 is fed to the feeding line 116.

In the transistor 123, the control signal Gcmp(i) is supplied to the gate node.

In the transistor 124, the control signal Gel(i) is supplied to the gate node and the drain nodes are respectively connected to the source node of the transistor 125 and the anode of the OLED 130.

In the transistor 125, the control signal Gorst(i) corresponding to the i-th row is supplied to the gate node and the drain node is connected to the feed line 16 corresponding to the (3j−2)th column and preserved at the potential Vorst.

Here, the transistor 121 is equivalent to a first transistor, the transistor 122 is equivalent to a second transistor, and the transistor 123 is equivalent to a third transistor. Further, the transistor 125 is equivalent to a fourth transistor, and the transistor 124 is equivalent to a fifth transistor.

The other end of the storage capacitor 132 is connected to the feed line 116, For this reason, the storage capacitor 132 holds the voltage between the source and drain of the transistor 121. Here, when the capacity of the storage capacitor 132 is denoted as Cpix, the capacity Cdt of the storage capacitor 50, the capacity Crf1 of the storage capacitor 44, and the capacity Cpix of the storage capacitor 132 are set so that:

$$Cdt > Crf1 >> Cpix$$

That is, Cdt is greater than Crf1, and Cpix is set to be sufficiently smaller than Cat and Crf1.

Here, as the storage capacitor 132, a capacity which is parasitic to the gate node g of the transistor 121 may be used, and a capacity formed by interposing an insulating layer with mutually different conductive layers in a silicon substrate may be used.

Since the electro-optical device 10 in the present embodiment is formed on silicon substrate, the substrate potential of the transistors 121 to 125 is set as the potential Vel.

The anode of the OLED 130 is a pixel electrode provided individually for each pixel circuit 110. In contrast, the cathode of the OLED 130 is a common electrode 118 which is common across all of the pixel circuits 110, and is preserved at a potential Vct which is a low-order side of the power source in the pixel circuits 110.

The OLED 130 is an element interposing a white organic EL layer between the anode and the cathode having a light-permeable characteristic in the above-described silicon substrate. Then, a color filter corresponding to any one of RGB is superimposed on the output side (cathode side) of the OLED 130.

In such an OLED 130, when a current flows from the anode to the cathode, holes injected from the anode and electrons injected from the cathode are recombined in the organic EL layer to generate excitons, whereby white light is generated. A configuration is adopted in which the white light generated at this time is transmitted through the cathode on the opposite side to the silicon substrate (anode) colored using the color filter, and made visible on the observer side.

Operation of First Embodiment

Figure 4:
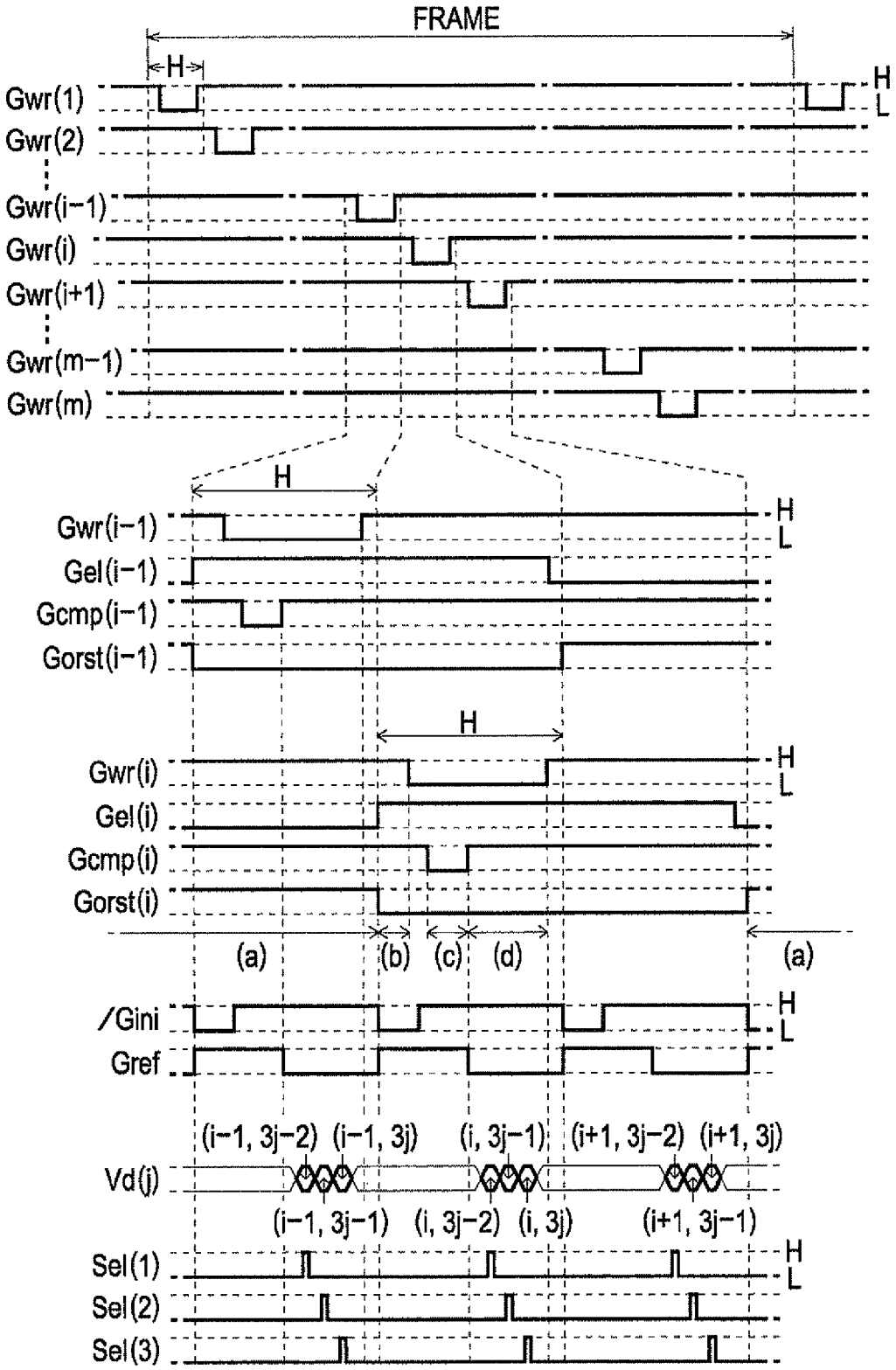
FIG. 4 is a timing chart showing an operation of the electro-optical device.

The operation of the electro-optical device 10 will be described with reference to FIG. 4. FIG. 4 is a timing chart for illustrating the operation of each part in the electro-optical device 10.

As shown in the drawings; the scanning signals Gwr(1) to Gwr(m) are sequentially switched to the L level and the scan lines 12 of rows 1 to m are scanned in order for each horizontal scanning period (H) in a period of one frame.

The operation in one horizontal scanning period (H) is common across the pixel circuits 110 of each row. Here, below, in the scanning period in which the i-th rows are horizontally scanned, description will be given of the operation with particular focus on the pixel circuit 110 of the i-th row, (3j−2)th column.

In the present embodiment, to make broad classifications, the scan period of the i-th row is divided into the initialization period shown by (b) in FIG. 4, the compensation period shown by (c), and the writing period shown by (d). Here, after the writing period (d), there is an interval before entering the light emitting period shown by (a), which leads to the scanning period of the i-th row again after the one frame period has elapsed. For this reason, with regard to the chronological order, the cycle of (light emitting period)→initialization period→compensation period→writing period→(light emitting period) is repeated.

Here, in FIG. 4, each of the scan signal Gwr(i−1) and the control signals Gel(i−1), Gcmp(i−1), and Gorst(i−1) corresponding to the (i−1) row one row before the i-th row is a waveform chronologically preceding the scan signal Gwr(i) and the control signals Gel(i), Gcmp(i), and Gorst(i) corresponding to the i-th row by the time of one horizontal scanning period (H) respectively.

Light Emitting Period

For convenience of explanation, description will be given from the light emitting period which is a prerequisite for the initialization period. As shown in FIG. 4, in the light emitting period of the i-th row, the scan signal Gwr(i) is the H level and the control signal Gel(i) is the L level. In addition, among the control signals Gel(i), Gcmp(i), and Gorst(i), the control signal Gel(i) is L level, and the control signals Gcmp(i) and Gorst(i) are H level.

Figure 5:
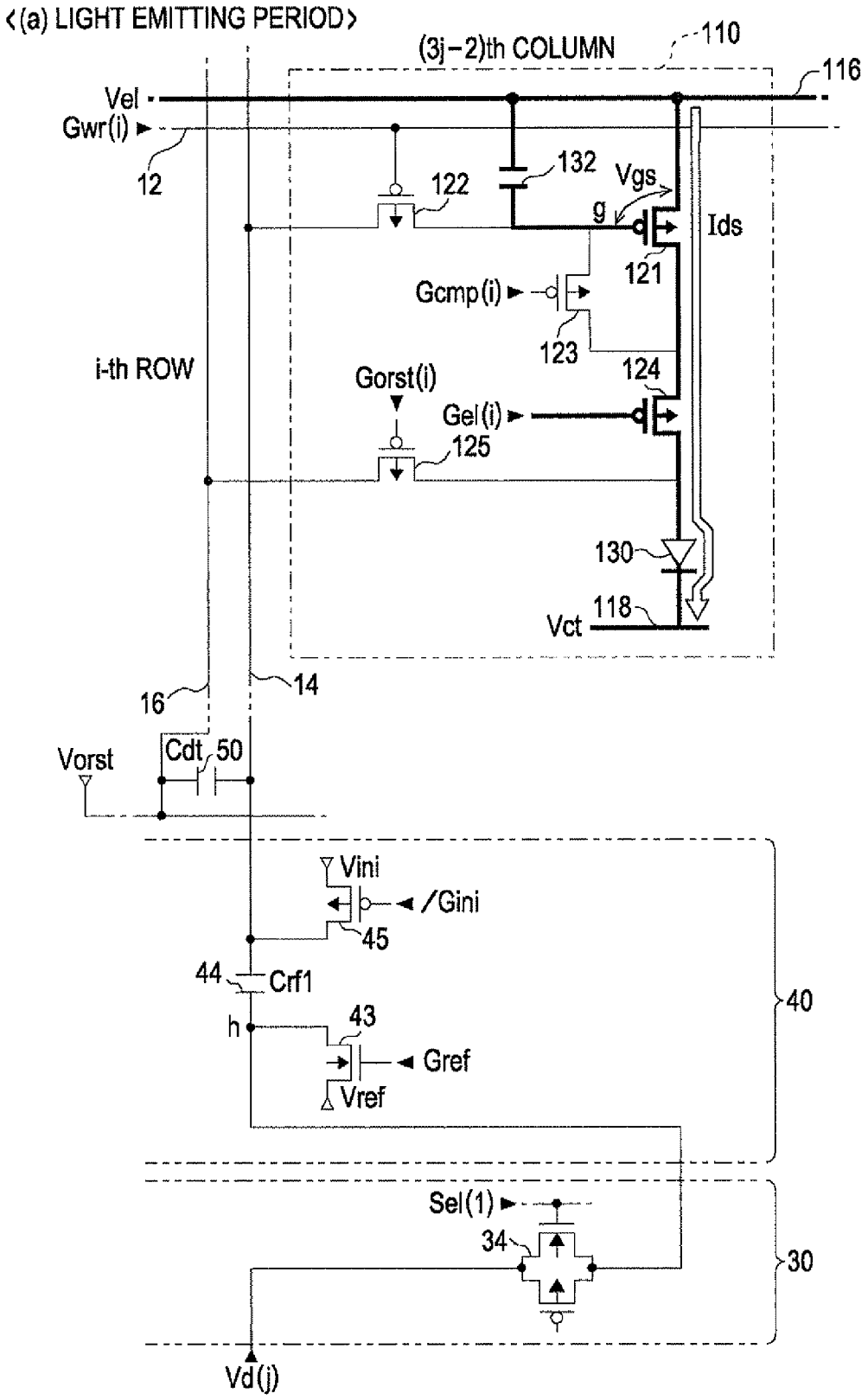
FIG. 5 is an explanatory diagram of an operation of the electro-optical device.

For this reason, in the pixel circuit 110 of the i-th row (3j−2)th column as shown in FIG. 5, the transistor 124 is turned on while the transistors 122, 123, and 125 are turned off. Accordingly, the transistor 121 supplies the current Ids according to the voltage Vgs between the gate and source to the OLED 130. As will be described below, in the present embodiment, the voltage Vgs in the light emitting period is a value level-shifted from the threshold voltage of the transistor 121 according to the potential of the data signal. For this reason, a current according to the gradation level will be supplied to the OLED 130 in a state where the threshold voltage of the transistor 121 is compensated.

Here, since the light emitting period of the i-th row is a period in which horizontal scanning other than of the i-th row is performed, the potential of the data line 14 changes appropriately. However, since the transistor 122 is turned off in the i-th row of the pixel circuit 110, here, the potential change of the data line 14 is not taken into consideration.

In addition, in FIG. 5, the route which is important in the operation description is shown with a bold line (the same applies in FIGS. 6 to 8, and FIGS. 13 to 16 below).

Initialization Period

Next, when the scanning period of the i-th row is reached, first, the initialization period of (b) is started as the first period. In the initialization period, in contrast to the light emitting period, respective changes are made such that the control signal Gel(i) becomes the H level and the control signal Gorst(i) becomes the L level.

Figure 6:
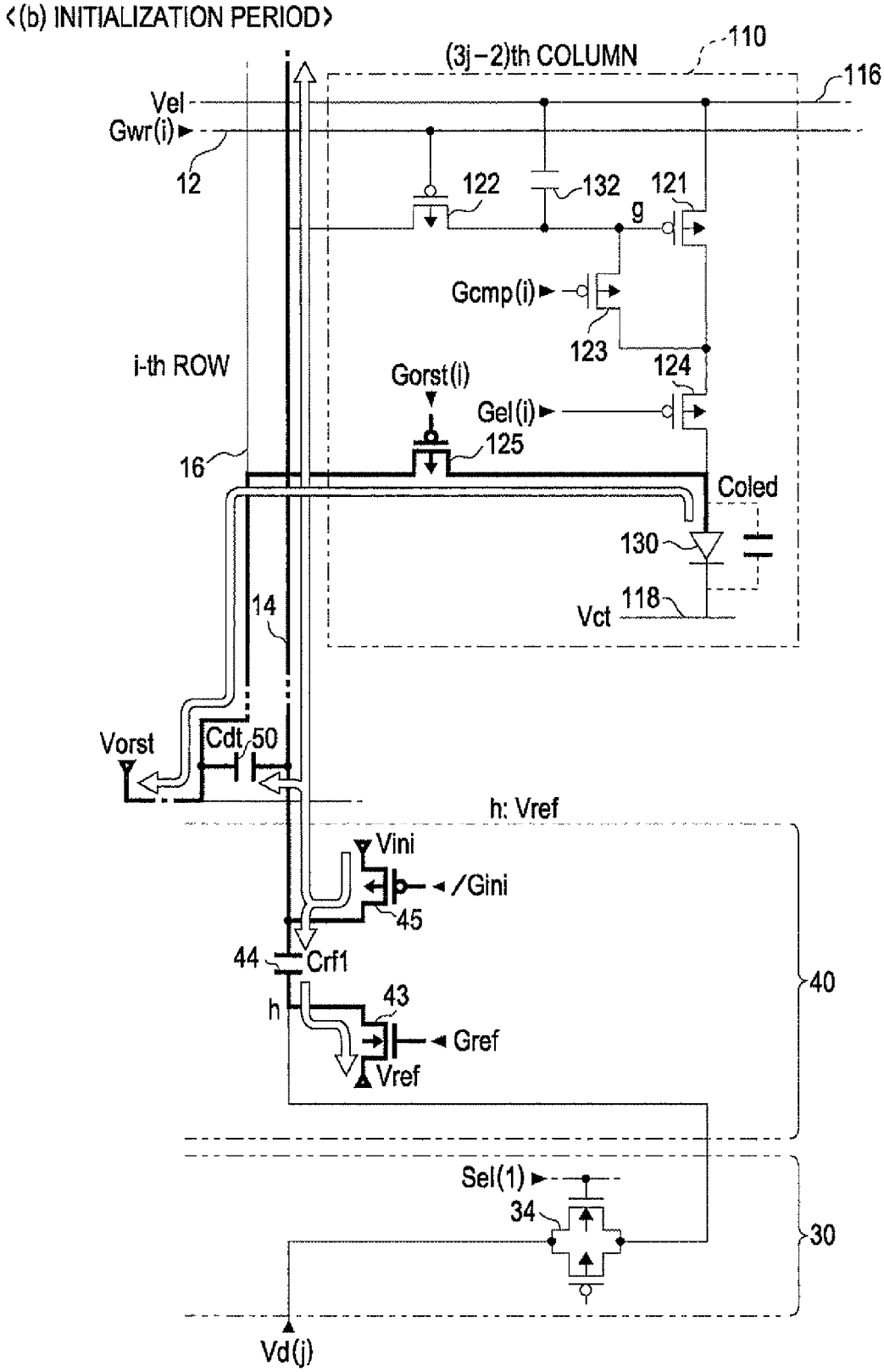
FIG. 6 is an explanatory diagram of an operation of the electro-optical device.

For this reason, in the pixel circuit 110 of the i-th row (3j−2)th column as shown in FIG. 6, the transistor 124 is turned off and the transistor 125 is turned on. In this manner, the route of the current supplied to the OLED 130 is interrupted and the anode of the OLED 130 is reset to the potential Vorst.

Since the OLED 130 has a configuration in which an organic layer EL is interposed between the above-described anode and cathode, between the anode and the cathode, the capacity Coled has a parasitic effect in parallel as shown by the dashed line in the diagram. When the current was flowing in the OLED 130 in the light emitting period, the voltage of both ends between the anode and the cathode of the OLED 130 is held by the capacity Coled; however, the holding voltage is reset by the turning on of the transistor 125. For this reason, in the present embodiment, when the current flows again in the OLED 130 in the next light emitting period, influence due to the voltage held by the capacity Coled is less likely.

In detail, for example, when changed from a high-luminance display state to a low-luminance display state, when the configuration in one which is not reset, since the high voltage of the time when the luminance is high (a large current flowing) is held, next, even though it is intended that a small current be made to flow, an excessive current flows and it is not possible to change to a low-luminance display state. In contrast, in the present embodiment, since the potential of the anode of OLED 130 is reset by the turning on of the transistor 125, the reproducibility of the low brightness side can be improved.

Here, in the present embodiment, the potential Vorst is set so that the difference of the potential Vorst and the potential Vct of the common electrodes 118 falls below the light emitting threshold voltage of the OLED 130. For this reason, in the initialization period (compensation period and writing period to be described later), the OLED 130 is in an off (non-light emitting) state.

Meanwhile, since the control signal /Gini becomes the L level and the control signal Gref becomes the H level in the initialization period, in the level shift circuit 40, the transistors 45 and 43 as shown in FIG. 6 are respectively turned on. For this reason, the data line 14 which is one end of the storage capacitor 44 and the node h which is the other end of the storage capacitor 44 are respectively initialized at a potential Vini and a potential Vref.

The potential Vini in the present embodiment is set so that (Vel−Vini) becomes larger than the threshold voltage |Vth| of the transistor 121. In addition, since the transistor 121 is a P-channel type, the threshold voltage Vth set with the potential of the source node as a reference is negative. Therefore, in order to prevent confusion in the description of the high-low relationship, the threshold voltage is represented by the absolute value |Vth| and regulated by magnitude correlation.

Further, the potential Vref in the present embodiment is set to a value such that the potential of the node h in the following writing period is increased with respect to the potential obtainable by the data signals Vd(1) to Vd(n), for example, so as to become lower than the minimum value Vmin.

Compensation Period

The compensation period of (c) as the second period is next in the scanning period of the i-th row. In the compensation period, in contrast to the initialization period, the scanning signal Gwr(i) and the control signal Gcmp(i) become the L level. Meanwhile, in the compensation period, the control signal /Gini becomes the H level in a state where the control signal Gref is maintained at the H level.

Figure 7:
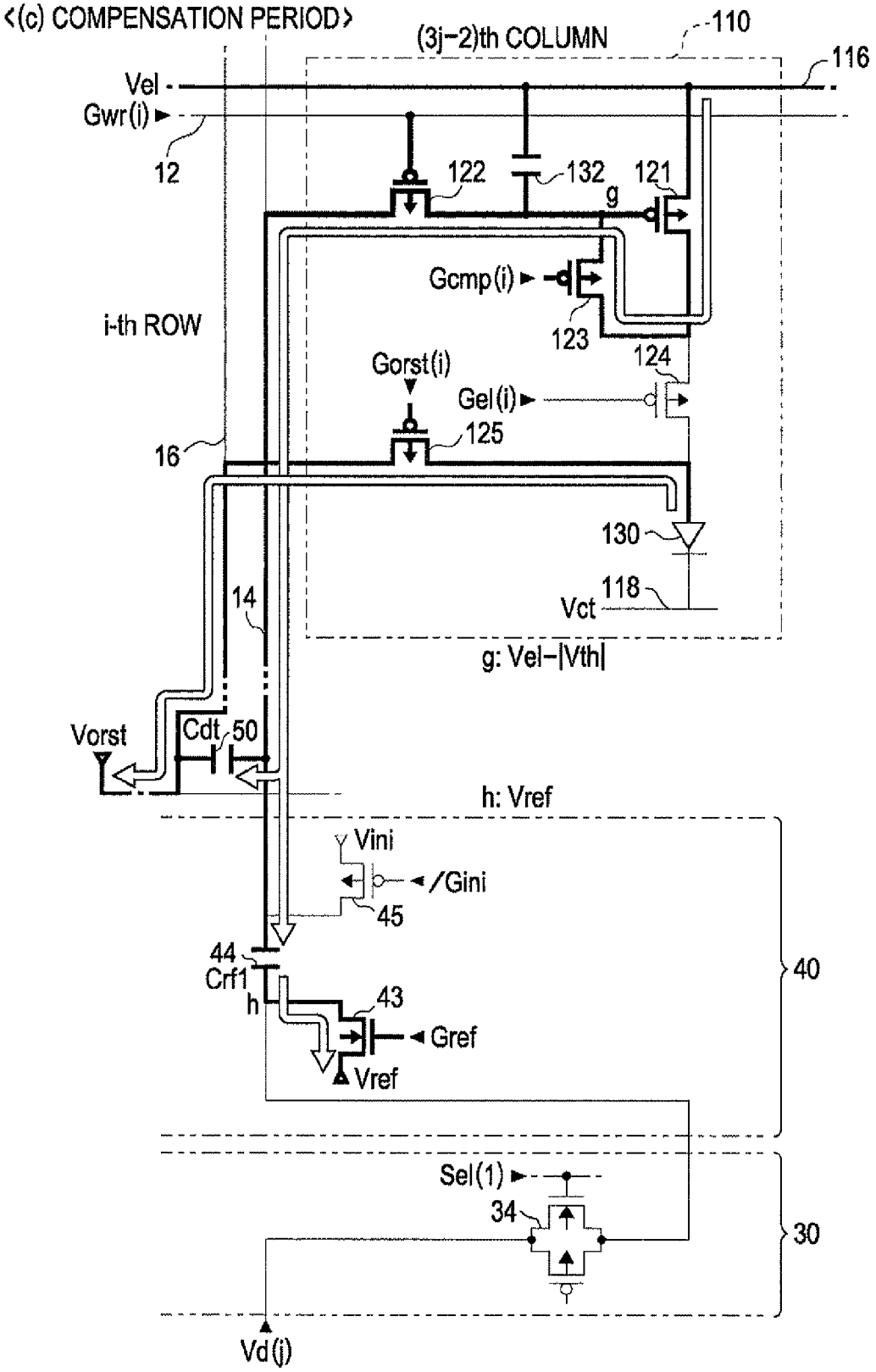
FIG. 7 is an explanatory diagram of an operation of the electro-optical device.

For this reason, as shown in FIG. 7, in the level shift circuit 40, the node h is fixed at a potential Vref by the turning off of the transistor 45 in the state where the transistor 43 is turned on. Meanwhile, since the gate node g is electrically connected to the data lines 14 by the turning on of the transistor 122 in the pixel circuit 110 of the i-th row, (3j−2)th column, the gate node g becomes the potential Vini at the initial start of the compensation period.

Since the transistor 123 is turned on in the compensation period, the transistor 121 becomes "diode-connected". For this reason, the drain current flows through the transistor 121 to charge the gate node g and the data line 14. In detail, the current flows in a path of the feed line 116→transistor 121→transistor 123→transistor 122→data line 14 of (3j−2)th column. For this reason, the data line 14 and the gate node g mutually connected by the turning on of the transistor 121 are increased from the potential Vini.

However, since the current flowing through the above-described route flows less easily as the gate node g becomes closer to the potential (Vel−|Vth|), the data line 14 and the gate node g are saturated with the potential (Vel−|Vth|) until the compensation period is finished. Accordingly, the storage capacitor 132 holds the threshold voltage |Vth| of the transistor 121 until the compensation period is finished.

Writing Period

After the initialization period, the writing period of (d) is reached as the third period. In the writing period, since the control signal Gcmp(i) is the H level when the compensation period is finished, the control signal Gref becomes the L level while the diode-connection of the transistor 121 is ended, whereby the transistor 43 is turned off. For this reason, the route leading up to the gate node g in the pixel circuit 110 of the i-th row, (3j−2)th column from the data line 14 of the (3j−2)th column is in a floating state; however, the potential in the route is maintained at (Vel−|Vth|) by the holding capacities 50 and 132.

In the writing period of the i-th row, the control circuit 5 sequentially switches the data signal Vd(j) to the potential according to the gradation level of the pixels of the i-th row, (3j−2)th column, the i-th row, (3j−1)th column, and the i-th row, (3j)th column in the j-numbered group. Meanwhile, the control circuit 5 sequentially sets the control signals Sel(1), Sel(2), and Sel(3) in order exclusively to the H level in combination with the switching of the potential of the data signal. In addition, although omitted in FIG. 4, the control circuit 5 performs output for the control signals /Sel(1), /Sel(2), and /Sel(3), which have a logic inverted relationship with the control signals Sel(1), Sel(2), and Sel(3). In this manner, in the demultiplexer 30, the transmission gates 34 are turned on in order of the left end column, the center column, and the right end column respectively in each group.

Figure 8:
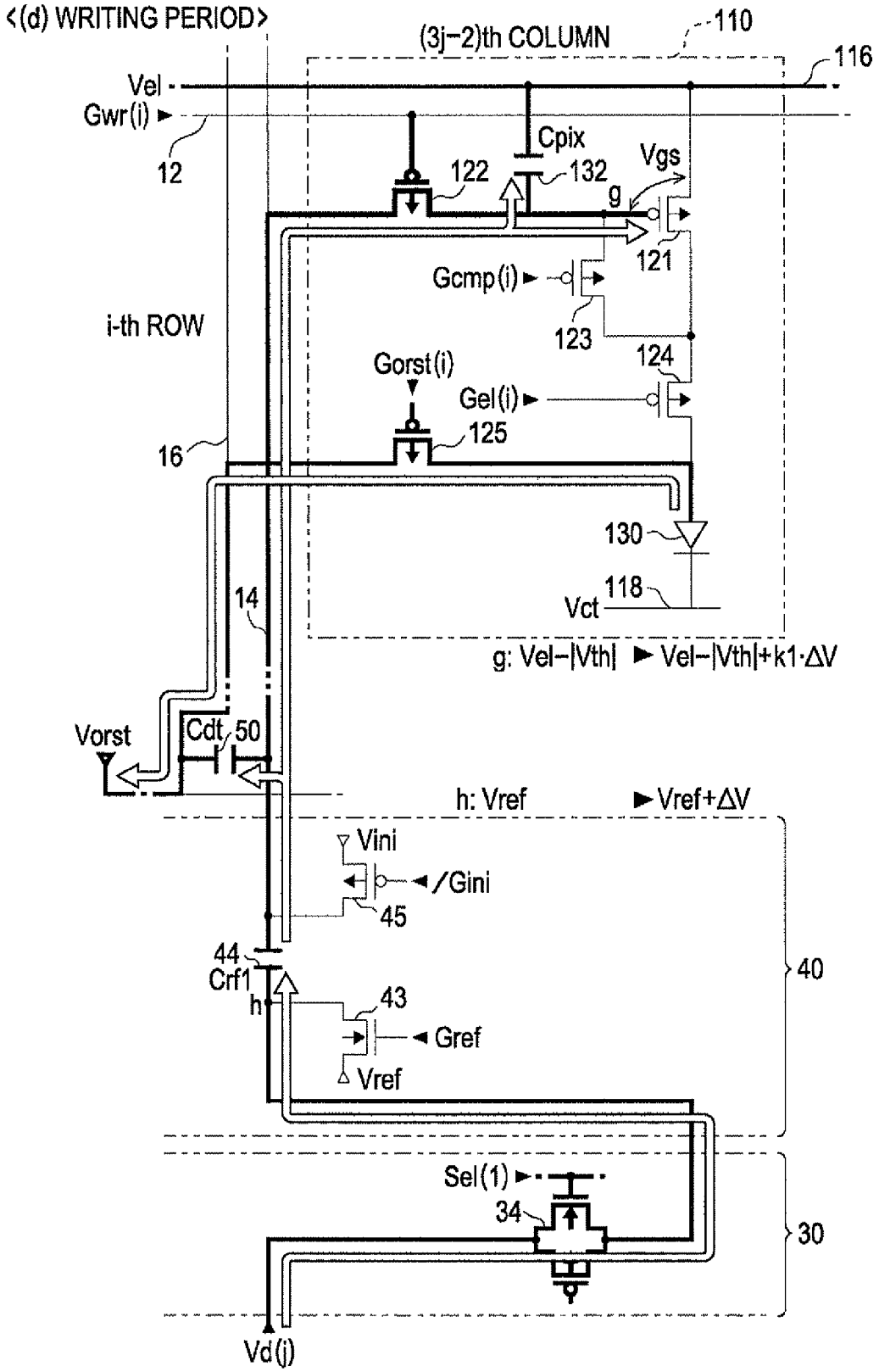
FIG. 8 is an explanatory diagram of an operation of the electro-optical device.
Figure 9:
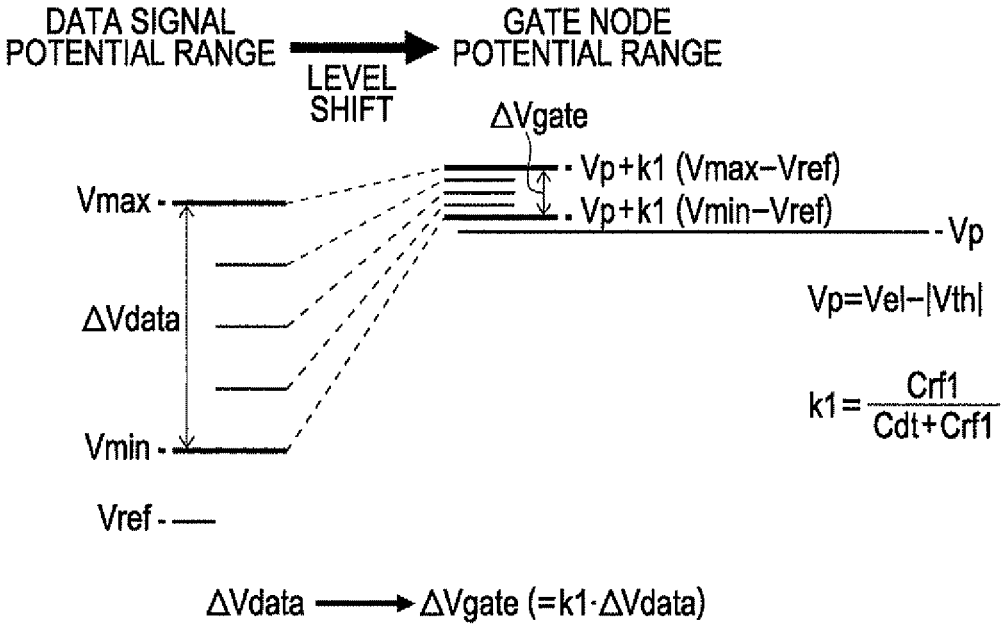
FIG. 9 is a diagram showing amplitude compression of a data signal in the electro-optical device.

Here, when the transmission gate 34 of the left end column is turned on by the control signals Sel(1) and /Sel(1), as shown in FIG. 8, the node h which is the other end of the storage capacitor 44 is changed to the potential of the data signal Vd(j) from the fixed potential Vref in the initialization period and the compensation period, that is, to the potential according to the gradation level of the pixels of the i-th row, (3j−2)th column. The potential change amount of the node h at this time is represented as ΔV, and the potential after the change as (Vref+ΔV).

Meanwhile, since the gate node g is connected to one end of the storage capacitor 44 through the data line 14, it becomes a value (Vel−|Vth|+k1·ΔV) shifted in an increasing direction from the potential (Vel−|Vth|) in the compensation period by a value in which the capacity ratio k1 is multiplied by the potential change amount ΔV of the node h. At this time, when expressed, as an absolute value by the voltage Vgs of the transistor 121, it becomes a value (|Vth|−k1·ΔV) in which the shift amount of the increase in the potential of the gate node g is subtracted from the threshold, voltage |Vth|.

In addition, the capacity ratio k1 is Crf1/(Cdt+Crf1). Strictly speaking, the capacity Cpix of the storage capacitor 132 must also be considered; however, since the capacity Cpix is set to be sufficiently small in comparison with the capacities Crf1 and Cdt, it may be ignored.

FIG. 3 is a diagram showing the relationship between the potential of the data signal and the potential of the gate node g in the writing period. The data signal supplied from the control circuit 5 can obtain a potential range from the minimum value Vmin to the maximum value Vmax according to the gradation level of the pixels as described above. In the present embodiment, the data signal is not written to the direct gate node g, but level-shifted as shown in the diagram and written to the gate node g.

At this time, the potential range ΔV gate of the gate node g is compressed to a value obtained by multiplying the potential range ΔV data (=Vmax−Vmin) of the data signal by the capacity ratio k1. For example, when the capacities of the holding capacities 44 and 50 are set so that Crf1:Cdt=1:9, the potential range ΔV gate of the gate node g can be compressed to 1/10 of the potential range ΔV data of the data signal.

In addition, the extent to which the potential range ΔV gate of the gate node g is shifted in which direction with respect to the potential range ΔV data of the data signal can be set using the potential Vp (=Vel−|Vth|) and Vref. This is because, when the potential range ΔV data of the data signal is compressed with the capacity ratio k1 with the potential Vref as a reference and, along with this, the compression range shifts the potential Vp to the reference, the result is the potential range ΔV gate of the gate node g.

In this manner, in the writing period of the i-th row, a potential (Vel−|Vth|+K1·ΔV) shifted by an amount according to the capacity ratio k1 from the potential (Vel−|Vth|) in the compensation period to the potential change amount ΔV of the node h is written to the gate node g of the pixel circuit 110 of the i-th row.

After a short time, the scanning signal Gwr(i) becomes the H level and the transistor 122 is turned off. In this manner, the writing period is finished and the potential of the gate node g is determined as the shifted value.

Light Emitting Period

After the writing period of the i-th row finishes, there is an interval of one horizontal scanning period leading to the light emitting period. In the light emitting period, since the control signal Gel(i) becomes the L level as described above, in the pixel circuit 110 of the i-th row, (3j−2)th column, the transistor 124 is turned on. Since the voltage Vgs between the gate and the source is (|Vth|−k1 ΔV)), as shown previously in FIG. 5, a current according to the gradation level will be supplied to the OLED 130 in a state where the threshold voltage of the transistor 121 is compensated.

These kinds of operations are chronologically performed in parallel even in other pixel circuits 110 of the i-th row other than the pixel circuit 110 of the (3j−2)th column in the scanning period of the i-th row. In addition, this operation of the i-th row is performed in order of the 1, 2, 3, . . . , (m−1), m rows in the period of one frame in practice and this is repeated for each frame.

According to the present embodiment, since the potential range ΔV gate in the gate node g is narrowed with respect to the potential range ΔV data of the data signal, it is possible to apply a voltage in which the gradation level between the gate and source of the transistor 121 is reflected even without cutting up the data signal with fine precision. For this reason, even in a case where a micro current flowing to the OLED 130 with respect to the voltage Vgs between the gate and the source of the transistor 121 in the miniaturized pixel circuit 110 is changed to a relatively large extent, it is possible to control the current supplied to the OLED 130 with fine precision.

In addition, between the data line 14 and the gate node g in the pixel circuit 110 as shown by the dashed lines in FIG. 3, the capacity Cprs has a parasitic effect in practice. For this reason, when the potential change width of the data line 14 is large, there is propagation through the capacity Cprs and so-called cross-talk, nonuniformity, or the like is generated and the display quality is deteriorated. The influence of the capacity Cprs is remarkably apparent when the pixel circuit 110 is miniaturized.

In contrast, in the present embodiment, since the potential change range of the data line 14 is narrowed with respect to the potential range ΔV data of the data signal, it is possible to limit the influence of the capacity Cprs.

According to the present embodiment, as the period in which the transistor 125 is turned on, that is, the reset period of the OLED 130, since it is possible to ensure a period longer than the scanning period, for example, two horizontal scanning periods, it is possible to sufficiently initialize the voltage held in the parasitic capacitance of the OLED 130 in the light emitting period.

In addition, according to the present embodiment, the current Ids supplied to the OLED 130 by the transistor 121 cancels the influence of the threshold voltage. For this reason, according to the present embodiment, even when the threshold voltage of the transistor 121 is varied in each pixel circuit 110, since these variations are compensated and current according to the gradation level is supplied to the OLED 130, the generation of display nonuniformity impairing the uniformity of the display screen can be suppressed and high-quality display becomes possible.

Figure 10:
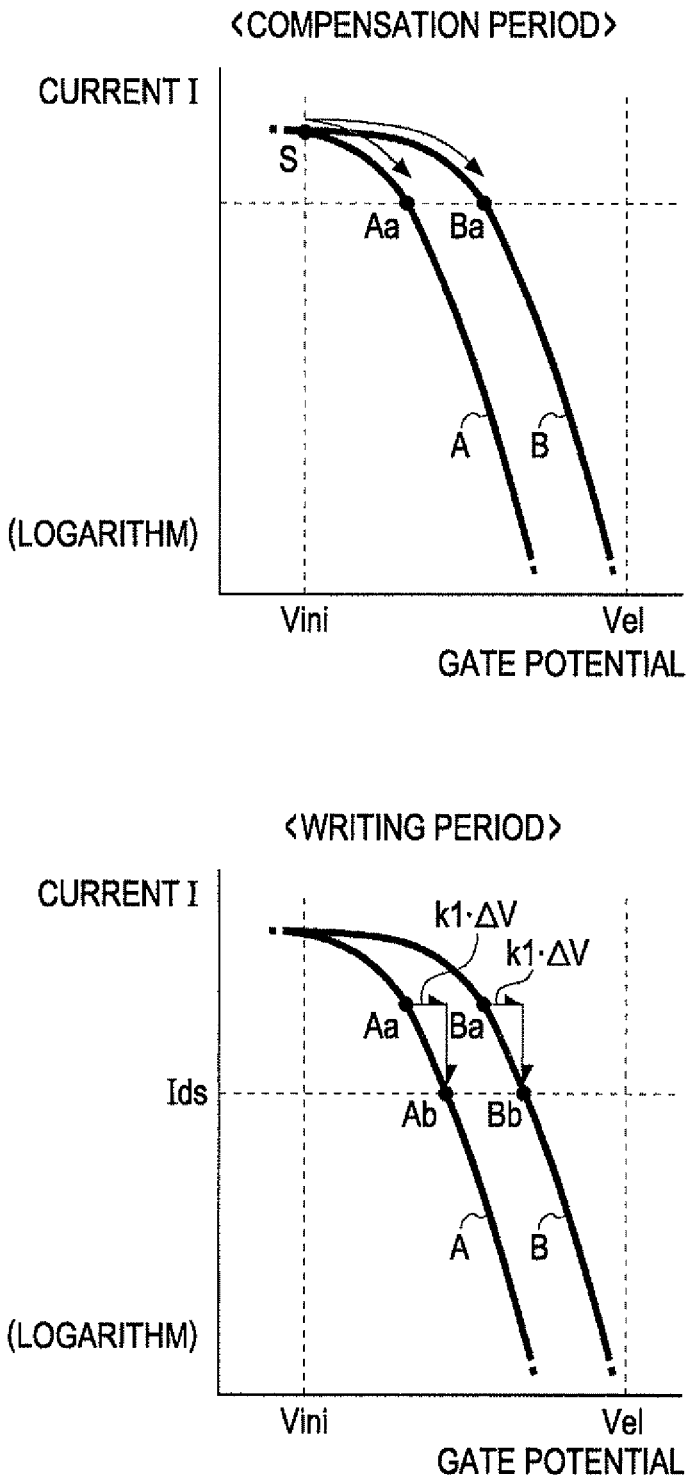
FIG. 10 is a diagram showing the characteristics of a transistor in the electro-optical device.

Description will be given of this cancellation with reference to FIG. 10. As shown in this diagram, in order to control the micro current supplied to the OLED 130, transistor 121 operates in a weak inversion region (sub-threshold region).

In the diagram, A and B respectively show the transistor in which the threshold voltage |Vth| is large and the transistor in which the threshold voltage |Vth| is small. Here, in FIG. 10, the voltage Vgs between the gate and the source is the difference between the characteristic shown by the solid line and the potential Vel. Further, in FIG. 10, the current of the vertical scale is shown by a logarithm in which the direction from the source to the drain is set to positive (up).

In the compensation period, the gate node g becomes a potential (Vel−|Vth|) from the potential Vini. For this reason, on one hand, for the transistor A in which the threshold voltage |Vth| is large, the operation point moves from S to Aa, while for the transistor B in which the threshold voltage |Vth| is small, the operation point moves from S to Ba.

Next, in a case where the potentials of the data signals to the pixel circuit 110 to which the two transistors belong are the same, in other words, in a case where the same gradation level is specified, the potential shift amount from the operation points Aa and Ba in the writing period are k1 ΔV, which is the same for both. For this reason, for the transistor A, the operation point moves from Aa to Ab and for the transistor B, the operation point moves from Ba to Bb; however, the current in the operation point after the potential shift is matched at almost the same Ids for both of the transistors A and B.

Second Embodiment

In the first embodiment, a configuration is adopted in which the data signals are directly supplied to the other ends of the holding capacities 44 of each column, that is, to the node h by the demultiplexer 30. For this reason, in the scanning period of each row, since the writing period is equal to the period in which the data signals are supplied from the control circuit 5, the time constraint is great.

Next, description will be given of a second embodiment in which it is possible to relax this time constraint. Here, in the following, in order to avoid repeated description, description will be given focusing on parts which are different than those of the first embodiment.

Figure 11:
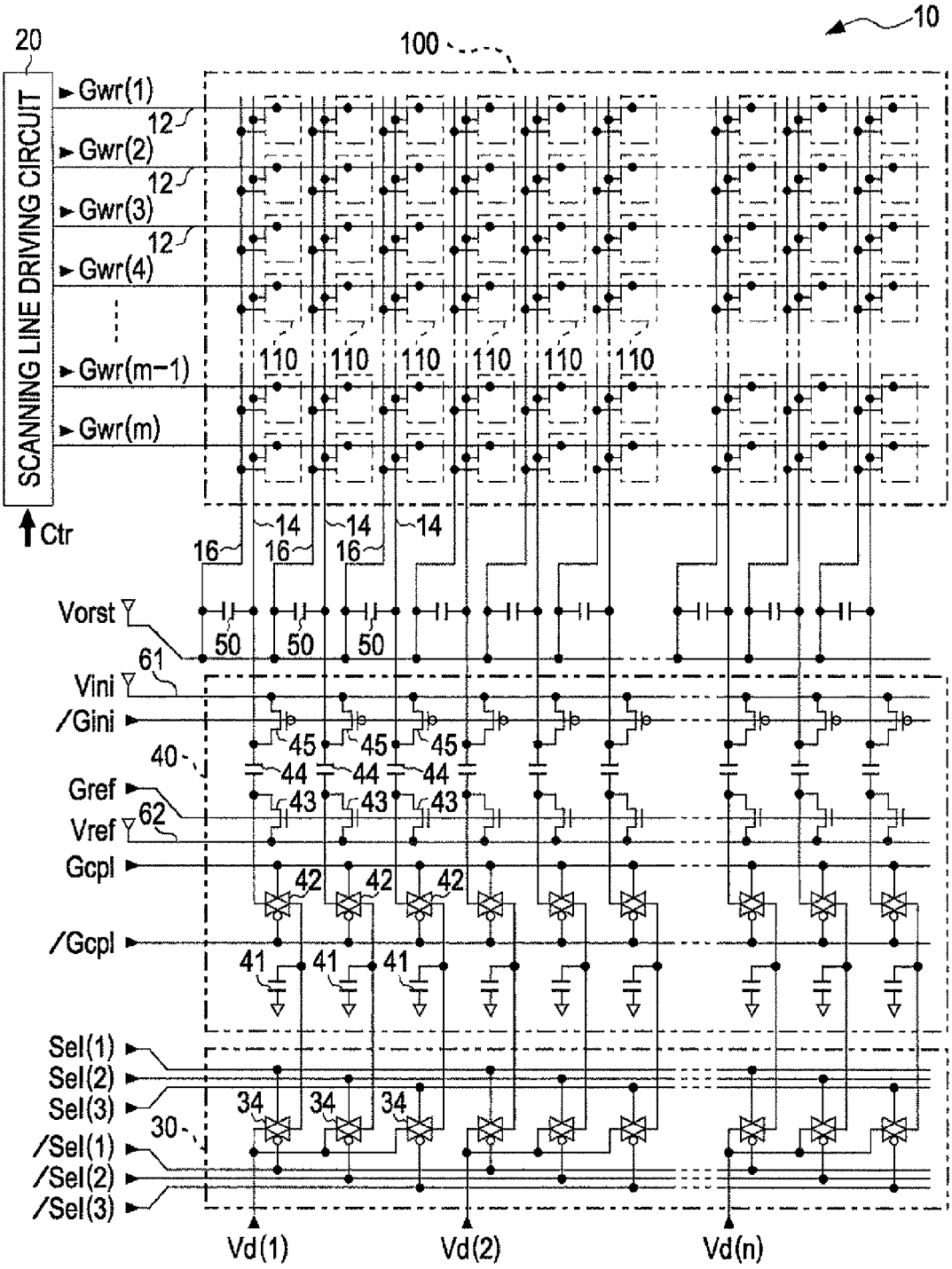
FIG. 11 is a diagram showing a configuration of an electro-optical device according to a second embodiment.

FIG. 11 is a diagram showing a configuration of an electro-optical device 10 according to the second embodiment.

The point in which the second embodiment shown in the diagram is different than the first embodiment shown in FIG. 2 is mainly that holding capacities 41 and transmission gates 42 are provided in each column of the level shift circuit 40.

In detail, the transmission gates 42 in each column are electrically interposed between the output ends of the transmission gates 34 and the other ends of the holding capacities 44. That is, the input ends of the transmission gates 42 are connected to the output ends of the transmission gates 34 and the output ends of the transmission gates 42 are connected to the other ends of the holding capacities 44. For this reason, the transistor gate 42 functions as a first switch.

Here, the transmission gates 42 of each column are turned on in unison when the control signal Gcpl supplied from the control circuit 5 is the H level (when the control signal /Gcpl is the L level).

Meanwhile, the transmission gate 34 in the demultiplexer 30 functions as a second switch.

In addition, one end of the storage capacitor 41 in each column is connected to the output end (input end of the transmission gate 42) of the transmission gate 34, and the other end of the storage capacitor 41, for example, is grounded in common to a fixed potential, for example, a potential Vss. Although not shown in FIG. 11, the holding capacitance of the storage capacitor 41 is set to Crf2. Here, the potential Vss is equivalent to the L level of the scanning signal and the control signal, which are logic signals.

Operation of Second Embodiment

Figure 12:
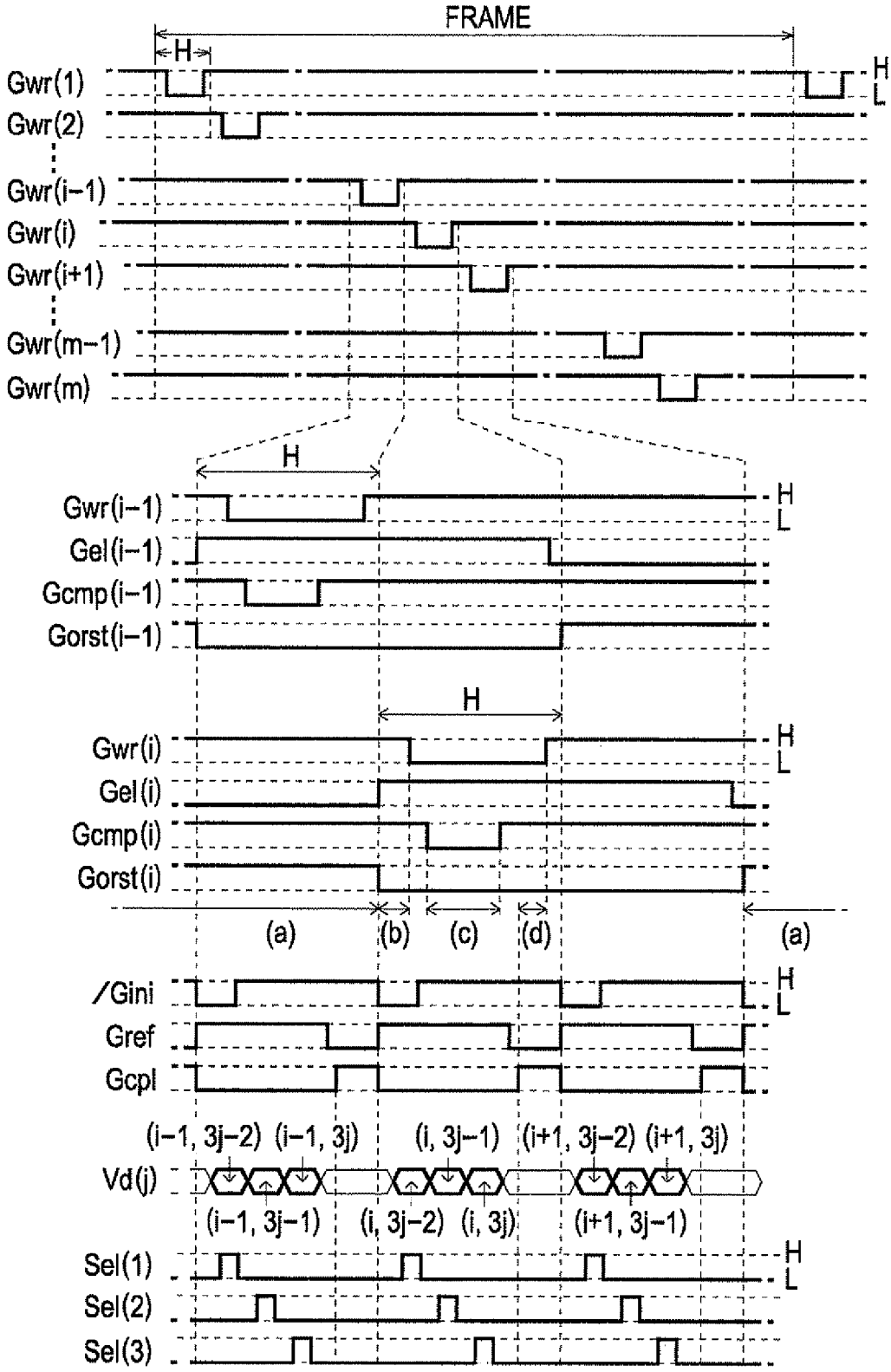
FIG. 12 is a timing chart showing an operation of the electro-optical device.

The operation of the electro-optical device 10 according to the second embodiment will be described with reference to FIG. 12. FIG. 12 is a timing chart for illustrating the operation in the second embodiment.

As shown in the drawings, the point that the scanning signals Gwr(1) to Gwr(m) are sequentially switched to the L level and the scan lines 12 of rows 1 to m are scanned in order for each horizontal scanning period (H) in a period of one frame is the same as in the first embodiment. In addition, in the second embodiment, the point that the scanning period of the i-th row is made of an initialization period shown by (b), a compensation period shown by (c), and a writing period shown by (d) is also the same as the first embodiment. Here, the writing period of (d) in the second embodiment is a period from the time the control signal Gcpl changes from the L to the K level (when the control signal /Gcpl has become the L level) until the time the scanning signal changes from the L to the H level.

In the second embodiment, similarly to the first embodiment, with regard to the chronological order, the cycle of (light emitting period)→initialization period→compensation period→writing period→(light emitting period) is repeated. However, the second embodiment is different to the first embodiment in the point that the writing period is not equal to the supply period of the data signal and the supplying of the data signal precedes the writing period. More specifically, the second embodiment is different from the first embodiment in the point, that the data signal can be supplied over the initialization period of (a) and the compensation period of (b).

Light Emitting Period

In the second embodiment, as shown in FIG. 12, in the light emitting period of the i-th row, the scan signal Gwr(i) is the H level and, furthermore, the control signal Gel(i) is the L level and the control signals Gcmp(i) and Gorst(i) are H level.

Figure 13:
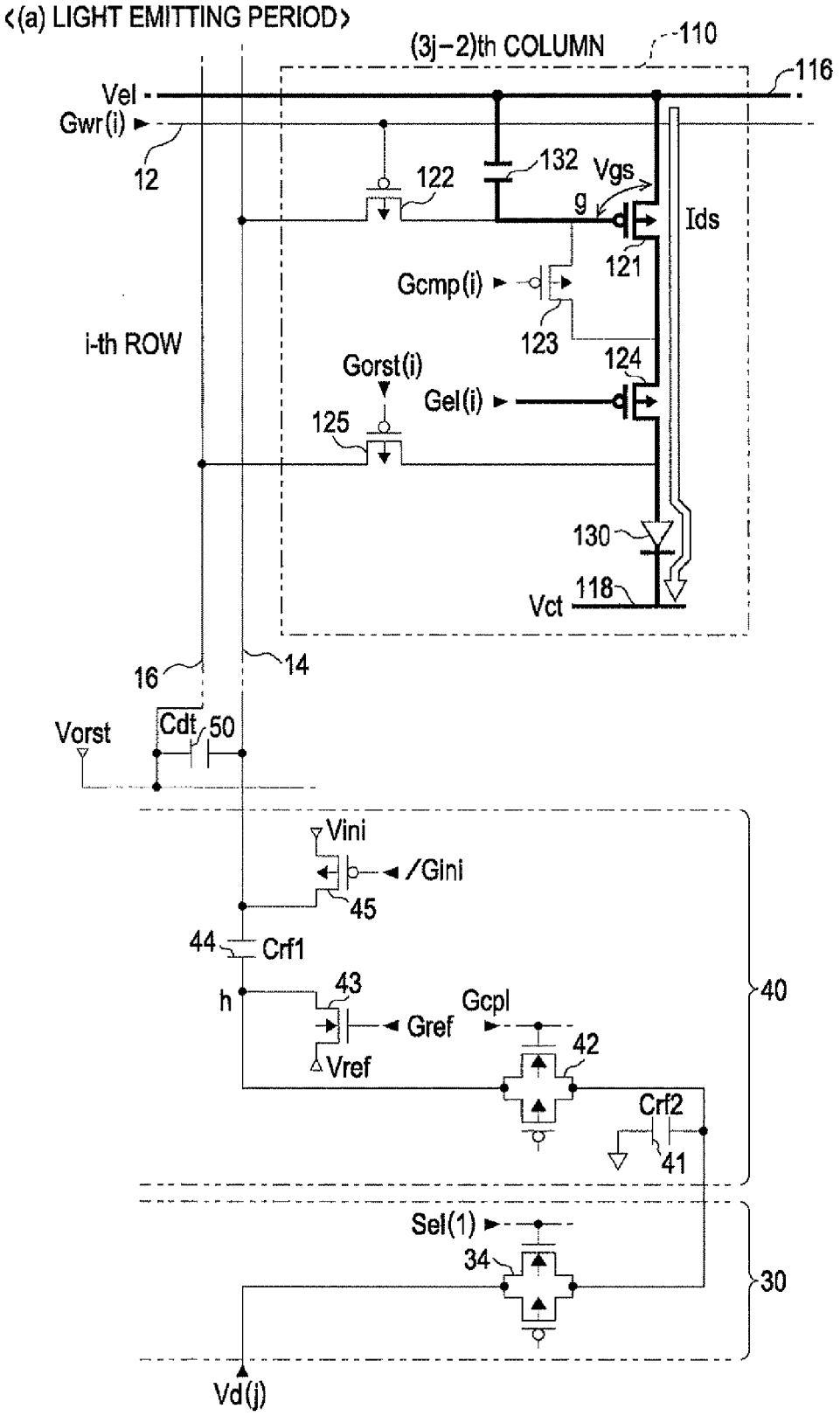
FIG. 13 is an explanatory diagram of an operation of the electro-optical device.

For this reason, in the pixel circuit 110 of the i-th row, (3j−2)th column as shown in FIG. 13, since the transistor 124 is turned on while the transistors 122, 123, and 125 are turned off, the operation in the pixel circuit 110 is basically the same as the first embodiment. That is, the transistor 121 supplies the current Ids according to the voltage Vgs between the gate and source to the OLED 130.

Initialization Period

When the scanning period of the i-th row is reached, first, the initialization period of (b) is started.

In the initialization period in the second embodiment, in contrast to the light emitting period, respective changes are made such that the control signal Gel(i) becomes the H level and the control signal Gorst(i) becomes the L level.

Figure 14:
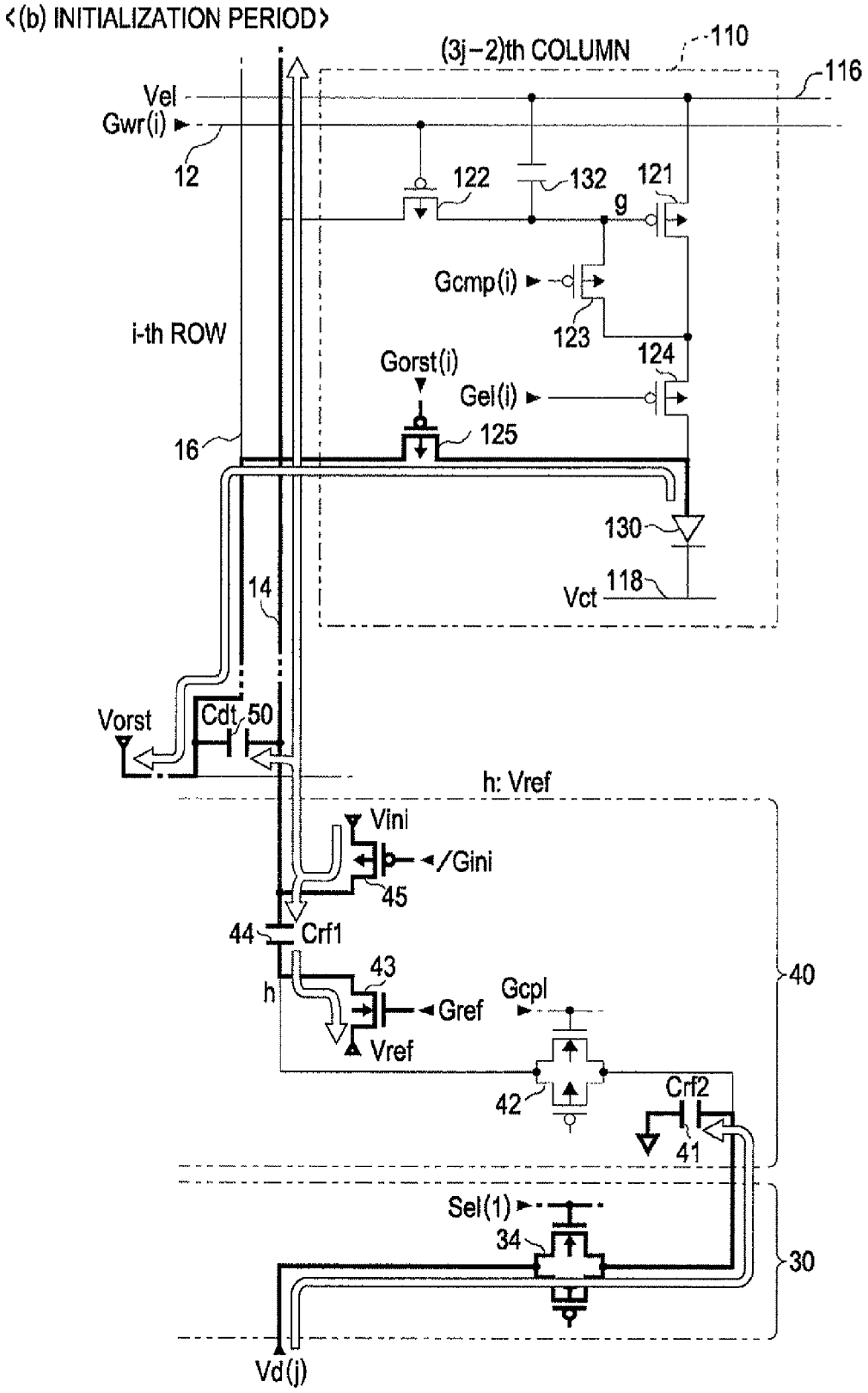
FIG. 14 is an explanatory diagram of an operation of the electro-optical device.

For this reason, in the pixel circuit 110 of the i-th row, (3j−2)th column as shown in FIG. 14, the transistor 124 is turned off and the transistor 125 is turned on. In this manner, since the route of the current supplied to the OLED 130 is interrupted and the anode of the OLED 130 is reset to the potential Vorst by the turning on of the transistor 124, the operation in the pixel circuit 110 is basically the same as the first embodiment.

Meanwhile, in the initialization period in the second embodiment, the control signal /Gini becomes the L level, the control signal Gref becomes the H level, and the control signal Gcpl becomes the L level. For this reason, in the level shift circuit 40, the transistors 45 and 43 are respectively turned on as shown in FIG. 14 and the transmission gate 42 is turned off. Accordingly, the data line 14 which is one end of the storage capacitor 44 and the node h which is the other end of the storage capacitor 44 are respectively initialized at a potential Vini and a potential Vref.

In the second embodiment, similarly to the first embodiment, the potential Vref is set to a value such that the potential of the node h in the following writing period is increased with respect to the potential obtainable by the data signals Vd(1) to Vd(n).

As described above, the control circuit 5 in the second embodiment supplies the data signals over the initialization period and the compensation period. In other words, the control circuit 5 sequentially switches the data signal Vd(j) to the potential according to the gradation level of the pixels of the i-th row, (3j−2)th column, the i-th row, (3j−1)th column, and the i-th row (3j) column in the j-numbered group and, while doing so, sets the control signals Sel(1), Sel(2), and Sel(3) in order exclusively to the H level in combination with the switching of the potential of the data signal. In this manner, in the demultiplexer 30, the transmission gates 34 are turned on in order of the left end column, the center column, and the right end column respectively in each group.

Here, in the initialization period, when the transmission gate 34 of the left end column belonging to the j-numbered group is turned on by the control signals Sel(1), as shown in FIG. 14, since the data signal Vd(j) is supplied to one end of the storage capacitor 41, the data signal is held by the storage capacitor 41.

Compensation Period

The compensation period of (c) is next in the scanning period of the i-th row. In the compensation period in the second embodiment, in contrast to the initialization period, respective changes are made such that the control signal Gwr(i) becomes the L level and the control signal Gcmp(i) becomes the L level.

Figure 15:
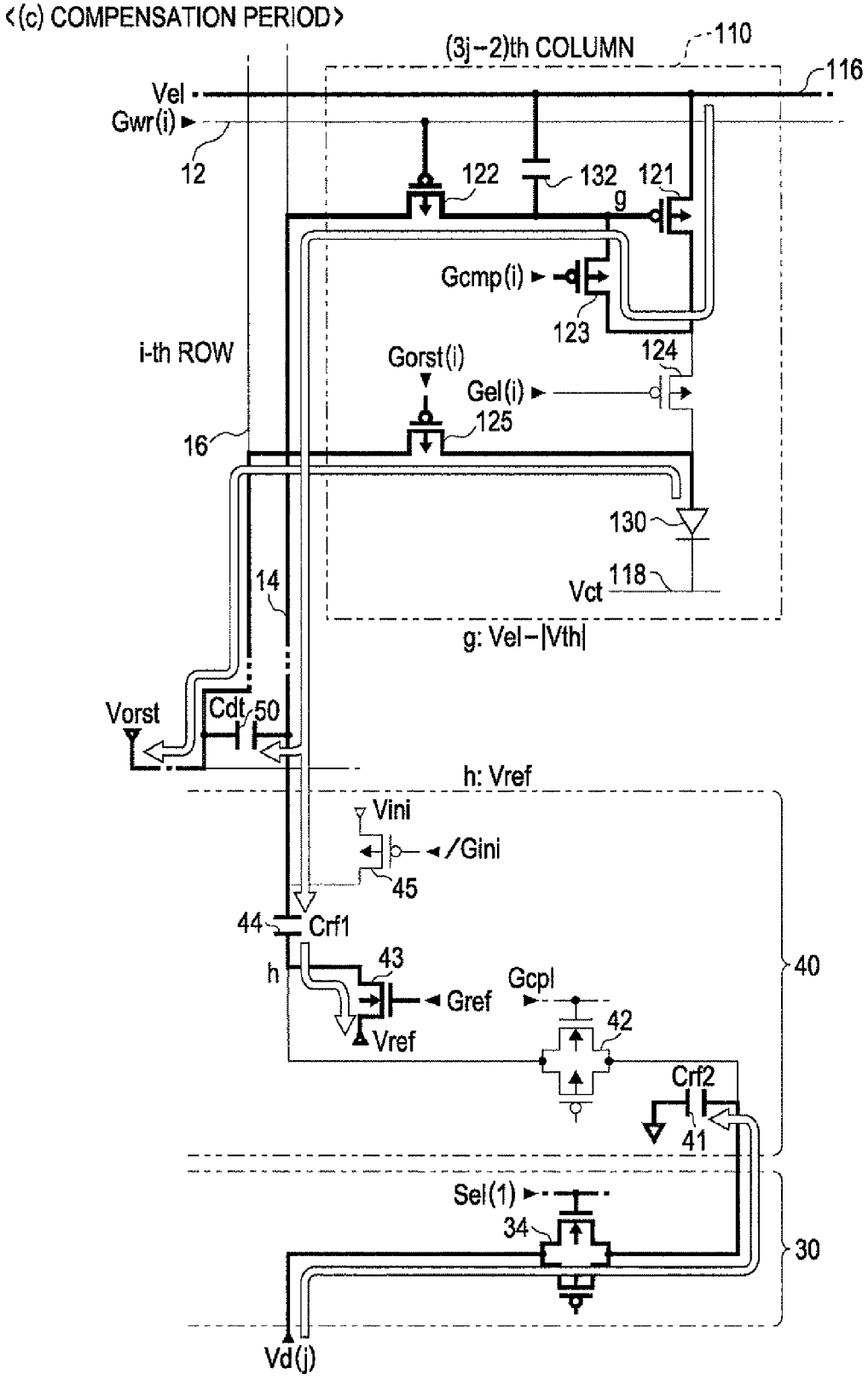
FIG. 15 is an explanatory diagram of an operation of the electro-optical device.

For this reason, while the transistor 122 is turned on in the pixel circuit 110 of the i-th row, (3j−2)th column as shown in FIG. 15 and the gate node g is electrically connected to the data, line 14, the transistor 121 becomes "diode-connected" due to the turning on of the transistor 123.

Accordingly, since the current flows in a path of the feed line 116→transistor 121→transistor 123→transistor 122→data line 14 of (3j−2)th column, the gate node g increases from the potential Vini and, after a short time, is saturated at (Vel−|Vth|). Accordingly, in the second embodiment, the storage capacitor 132 holds the threshold voltage |Vth| of the transistor 121 until the compensation period is finished.

In the second embodiment, in the compensation period, since the control signal /Gini becomes the H level in a state where the control signal Gref is maintained at the H level, the node h in the level shift circuit 40 is fixed at the potential Vref.

Further, in the compensation period, when the transmission gate 34 of the left end column belonging to the j-numbered group is turned on by the control signals Sel(1), as shown, in FIG. 15, the data signal Vd(j) is held by the storage capacitor 41.

Here, when the transmission gate 34 of the left end column belonging to the j-numbered group is already turned on by the control signals Sel(1) in the initialization period, the transmission gate 34 is not turned on in the compensation period; however, there is no change in the point that the data signal Vd(j) is held by the storage capacitor 41.

Further, since the control signal Gcmp(i) is the H level when the compensation period is finished, the diode-connection of the transistor 121 is ended.

In the second embodiment, since the control signal Gref becomes the L level in the time from the finishing of the compensation period to the start of the next writing period, the transistor 43 is turned off. For this reason, the route leading up to the gate node g in the pixel circuit 110 of the i-th row, (3j−2)th column from the data line 14 of the (3j−2)th column is in a floating state; however, the potential in the route is maintained at (Vel−|Vth|) by the holding capacities 50 and 132.

Writing Period

Figure 16:
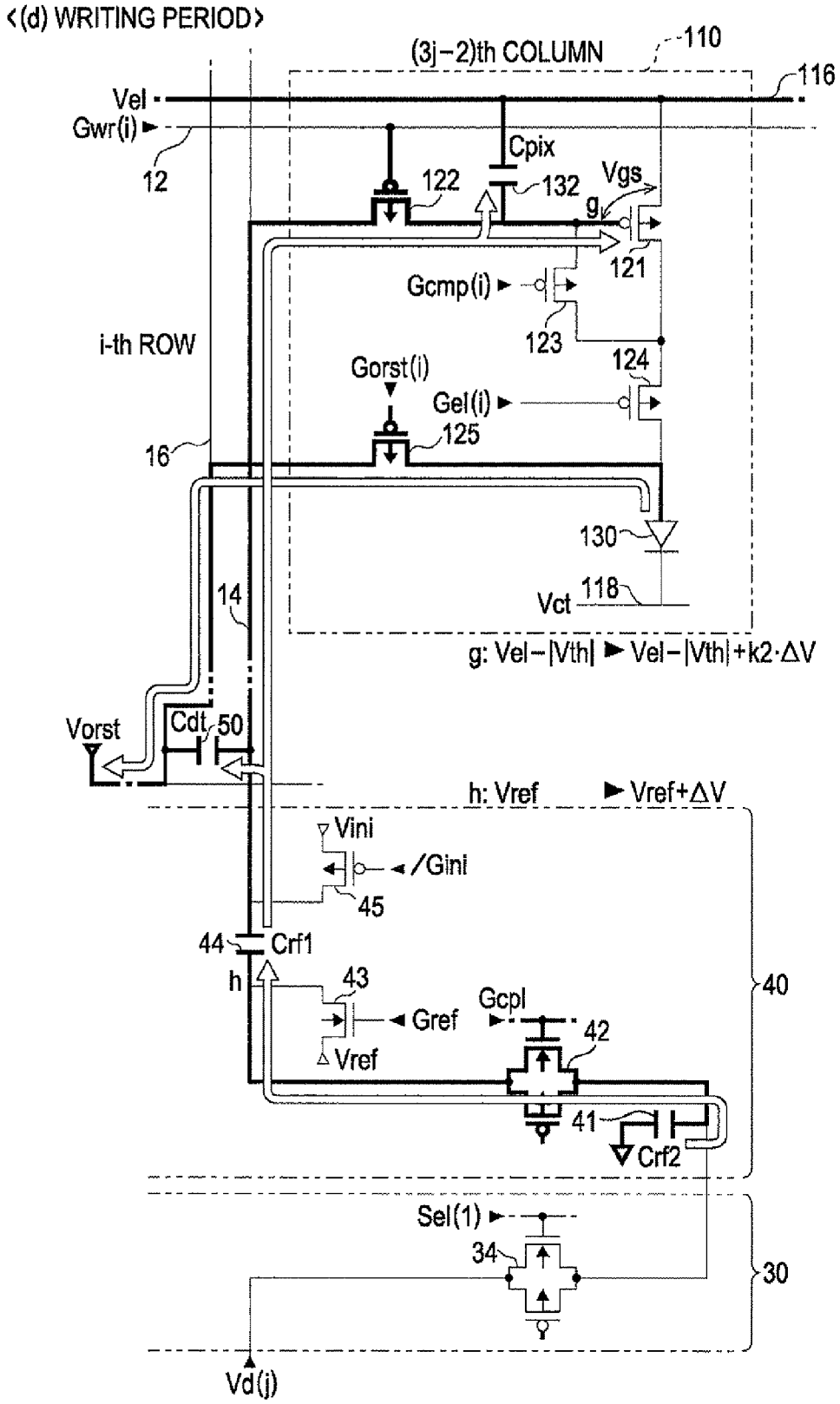
FIG. 16 is an explanatory diagram of an operation of the electro-optical device.

In the writing period in the second embodiment, the control signal Gcpl becomes the L level (the control signal /Gcpl becomes the L level). For this reason, as shown in FIG. 16, since the transmission gate 42 is turned on in the level shift circuit 40, the data signal held in the storage capacitor 41 is supplied to the node h which is the other end of the storage capacitor 44. For this reason, the node h shifts from the potential Vref in the compensation period. That is, the node h changes to the potential (Vref+ΔV).

Meanwhile, since the gate node g is connected to one end of the storage capacitor 44 through the data line 14, it becomes a value shifted in an increasing direction from the potential (Vel−|Vth|) in the compensation period by a value in which the capacity ratio k2 is multiplied by the potential change amount ΔV of the node h. That is, the potential of the gate node g becomes a value (Vel−|Vth|+k2 ΔV) shifted in an increasing direction from the potential (Vel−|Vth|) in the compensation period by a value in which the capacity ratio k2 is multiplied by the potential change amount ΔV of the node h.

Here, in the second embodiment, the capacity ratio k2 is the capacity ratio of Cdt, Crf1, and Crf2. As described above, the capacity Cpix of the storage capacitor 132 has been ignored.

Further, at this time, when expressed as an absolute value by the voltage Vgs of the transistor 121, it becomes a value (|Vth|−k2 ΔV) in which the shift amount of the increase in the potential of the gate node g is subtracted from the threshold voltage |Vth|.

Light Emitting Period

In the second embodiment, after the writing period of the i-th row finishes, there is an interval of one horizontal scanning period leading to the light emitting period. In the light emitting period, since the control signal Gel(i) becomes the L level as described above, in the pixel circuit 110 of the i-th row, (3j−2)th column, the transistor 124 is turned on.

The voltage Vgs between the gate and the source is (|Vth|−k2 ΔV) and is a value level-shifted from the threshold voltage of the transistor 121 according to the potential of the data signal. For this reason, as shown in FIG. 13, a current according to the gradation level will be supplied to the OLED 130 in a state where the threshold voltage of the transistor 121 is compensated.

These kinds of operations are chronologically performed in parallel even in other pixel circuits 110 of the i-th row other than the pixel circuit 110 of the (3j−2)th column in the scanning period of the i-th row. In addition, this operation of the i-th row is performed in order of the 1, 2, 3, . . . , (m−1), m rows in the period of one frame in practice and this is repeated for each frame.

According to the second embodiment, similar to the first embodiment, even in a case where a micro current flowing to the OLED 130 with respect to the voltage Vgs between the gate and the source of the transistor 121 in the miniaturized pixel circuit 110 is changed to a relatively large extent, it is possible to control the current supplied to the OLED 130 with fine precision.

According to the second embodiment, similar to the first embodiment, as well as being able to sufficiently initialize the voltage held by the parasitic capacitance of the OLED 130 in the light emitting period, the generation of display nonuniformity impairing the uniformity of the display screen can be suppressed even when the threshold voltage of the transistor 121 is varied in each pixel circuit 110, and, as a result, high-quality display becomes possible.

According to the second embodiment, the operation of holding the data signal supplied through the demultiplexer 30 from the control circuit 5 in the storage capacitor 41 is performed from the initialization period to the compensation period. For this reason, it is possible to relax the time constraints on the operation to be performed in one horizontal scanning period.

For example, since the current flowing in the transistor 121 decreases as the voltage Vgs between the gate and the source in the compensation period approaches the threshold voltage, time is needed for the gate nodes g to converge at the potential (Vel−|Vth|); however, in the second embodiment, it is possible to ensure a long compensation period as shown in FIG. 12 in comparison with the first embodiment. For this reason, according to the second embodiment, in comparison with the first embodiment, it is possible to compensate for the variation of the threshold voltage of transistor 121 with fine precision.

In addition, it is possible to slow down the supply operation of the data signals.

Application and Modification Examples

The invention is not limited to the embodiments described above or the embodiments and the like of application examples, and, for example, various kinds of modifications as described below are possible. In addition, the forms of the modifications described below can be arbitrarily selected or a plurality thereof can be combined.

Control Circuit

In the embodiments, the control circuit 5 for supplying a data signal is separate from the electro-optical device 10; however, the control circuit 5 may be integrated into the silicon substrate along with the scanning line driving circuit 20, the demultiplexer 30, and the level shift circuit 40.

Substrate

In the embodiments, a configuration was adopted in which the electro-optical device 10 was integrated with a silicon substrate; however, a configuration of being integrated with another silicon substrate may be adopted. Further, the forming may be made in a glass substrate or the like by the application of a polysilicon process. In any case, a configuration in which the pixel circuit 110 is miniaturized and the drain current is exponentially large with respect to changes in gate voltage Vgs in the transistor 121 is effective.

Control Signal Gcmp(i)

In the embodiments and the like, in the i-th row, the control signal Gcmp(i) was set to the H level in the writing period; however, it may be set to the L level. In other words, a configuration may be adopted in which the threshold compensation and the writing to the node gate g are performed in parallel by turning on the transistor 123.

Demultiplexer

In these embodiments, a configuration was adopted in which the data lines 14 are grouped every three columns, the data lines 14 are selected in order in each group, and the data signals are supplied; however, the number of data lines configuring a group may be "2", or may be "4" or more.

In addition, a configuration may be adopted in which grouping is not performed, that is, in which the data signals are supplied in unison line-sequentially to the data lines 14 of each column without using the demultiplexer 30.

Channel Type of Transistor

In the embodiments such as those described above, the transistors 121 to 125 in the pixel circuit 110 were standardized as P-channel type; however, they may be standardized as N-channel type. Further, the P-channel type and N-channel type may be suitably combined.

Other

In embodiments such as these, an OLED, which is a light emitting element was exemplified, as an electro-optical element; however, for example, it is sufficient if light is emitted with a luminance corresponding to the current, such as by an inorganic light emitting diode or an LED (Light Emitting Diode).

Electronic Apparatus

Next, description will be given of the electronic apparatus in which the electro-optical device 10 according to the embodiments and application examples is applied. The electro-optical device 10 is designed for use in high-definition displays with small-size pixels. Therefore, description will be given with a head-mounted display as an example of the electronic apparatus.

Figure 17:
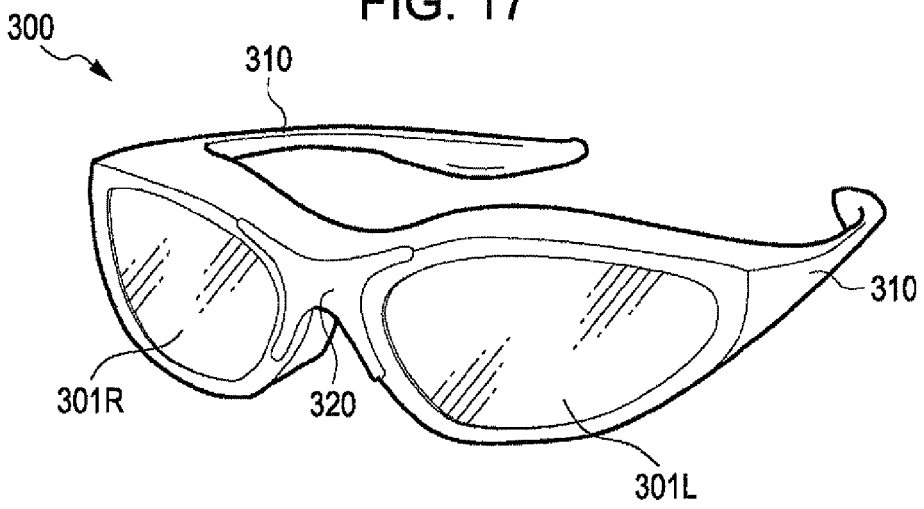
Figure 18:
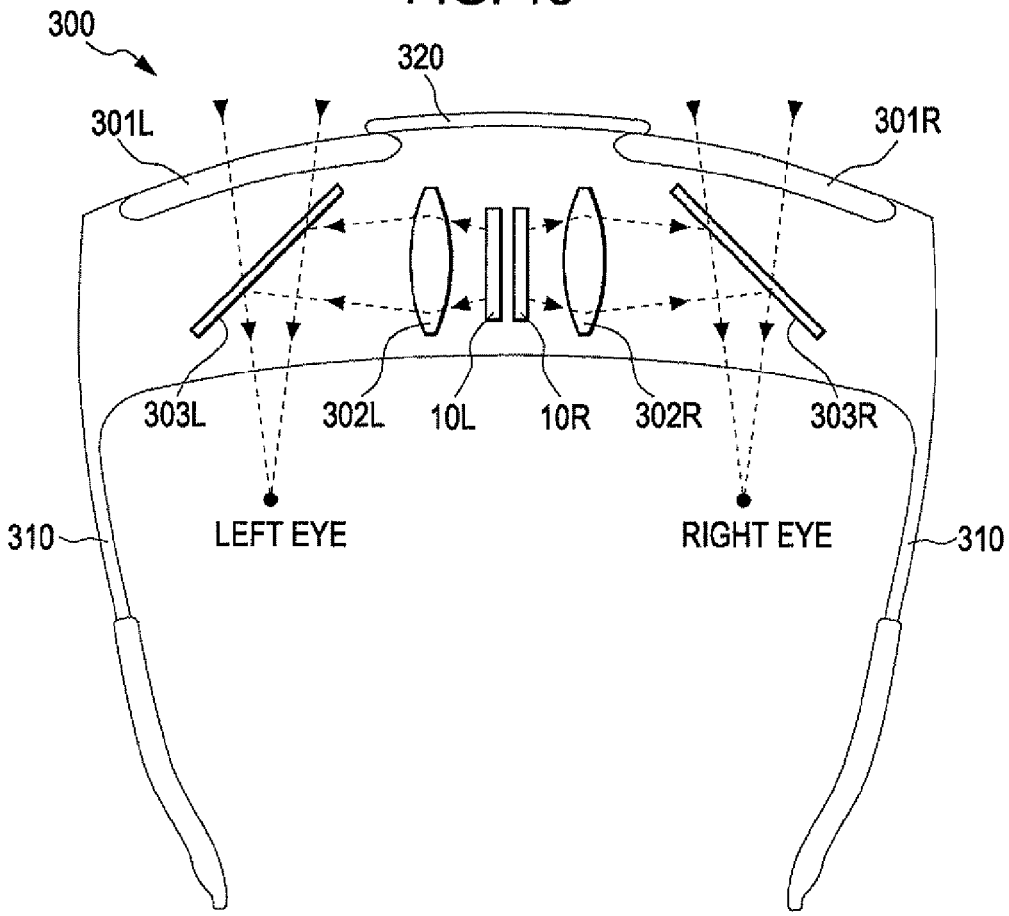
FIG. 18 is a diagram showing the HMD optical configuration.

FIG. 17 is a diagram showing the external appearance of a head mounted display and FIG. 18 is a diagram showing the optical configuration thereof.

First, as shown in FIG. 17, the head mounted display 300 is similar to normal glasses in terms of external appearance and has a temple 310, a bridge 320, and lenses 301L and 301R. In addition, as shown in FIG. 18, the head mounted display 300 is provided with an electro-optical device 10L for the left eye and an electro-optical device 10R for the right eye behind (lower part of the diagram) the lenses 301L and 301R in the vicinity of the bridge 320.

The image display surface of the electro-optical device 10L is arranged so as to be on the left side in FIG. 18. In this manner, the display image according to the electro-optical device 10L is output in the 9 o'clock direction in the diagram through the optical lens 302L. The half mirror 303L reflects the display image according to the electro-optical device 10L in the 6 o'clock direction while allowing light incident from the 12 o'clock direction to pass therethrough.

The image display surface of the electro-optical device 10R is arranged so as to be on the right side opposite to the electro-optical device 10L. In this manner, the display image according to the electro-optical device 10R is output in the 3 o'clock direction in the diagram through the optical lens 302R. The half mirror 303R reflects the display image according to the electro-optical device 10R in the 6 o'clock direction while allowing light incident from the 12 o'clock direction to pass therethrough.

In this configuration, the wearer of the head mounted display 300 can observe the display images according to the electro-optical devices 10L and 10R in a see-through state superimposed and combined with the situation outside.

In addition, in the head mounted display 300, when, in the two parallax images for both eyes, the left eye image is displayed by the electro-optical device 10L and the right eye image is displayed by the electro-optical device 10R, the displayed image can be perceived by the wearer as though having a sense of depth or three-dimensionality (3D display).

Here, in addition to the head mounted display 300, it is also possible to apply the electro-optical device 10 to an electronic type view finder in a video camera, an interchangeable lens-type digital camera, or the like.

What is claimed is:

1. An electro-optical device comprising:

a scanning line;

a data line intersecting to the scanning line;

a first capacitor including a first electrode and a second electrode, the first electrode being electrically connected to the data line;

a second capacitor including a third electrode and a fourth electrode, the third electrode being electrically connected to the data line, and the second capacitor holding a potential of the data line;

a first transistor being electrically connected to the data line and the first electrode of the first capacitor;

a second transistor being electrically connected to the second electrode of the first capacitor;

a first switch being electrically connected to the second electrode of the first capacitor;

a second switch being electrically connected to the first switch;

a third capacitor including a fifth electrode and a sixth electrode, the third capacitor being electrically connected between adjacent ends of the first switch and the second switch; and a pixel circuit being disposed at an intersection between the scanning line and the data line, the pixel circuit comprising:

an electro-optical element emitting a light;

a third transistor being electrically connected to the electro-optical element, the third transistor controlling a current that being supplied to the electro-optical element; and a fourth transistor being electrically connected to a gate of the third transistor and the data line, wherein the data line is supplied a first potential by turning on the first transistor, the second electrode of the first capacitor is supplied a second potential by turning on the second transistor, and the first switch turns off, in a first period, and wherein a data signal is supplied to the third capacitor in the first period by turning on the second switch.

2. The electro-optical device according to claim 1, further comprising:

a feed line being electrically connected to the fourth electrode of the second capacitor.

3. An electronic apparatus including the electro-optical device according to claim 2.

4. The electro-optical device according to claim 1, further comprising:

a fifth transistor being electrically connected to the gate of the third transistor and a drain of the third transistor, wherein the data line is connected to the drain of the third transistor by turning on the fourth transistor and the fifth transistor, the first switch turns off, in a second period which is a period after the first period, wherein the data signal is supplied to the one end of the first switch in the second period by turning on the second switch.

5. An electronic apparatus including the electro-optical device according to claim 4.

6. An electronic apparatus including the electro-optical device according to claim 1.

* * * * *